US006812443B2

(12) United States Patent
Noda et al.

(10) Patent No.: US 6,812,443 B2
(45) Date of Patent: Nov. 2, 2004

(54) MICROWAVE OVEN CAPABLE OF CHANGING THE WAY TO SUPPLY MICROWAVES INTO HEATING CHAMBERS

(75) Inventors: Masaru Noda, Otsu (JP); Eiji Fukunaga, Kusatsu (JP); Katsunao Takahashi, Otsu (JP); Katsuaki Hayami, Kyoto (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/743,471

(22) Filed: Dec. 23, 2003

(65) Prior Publication Data

US 2004/0134905 A1 Jul. 15, 2004

(30) Foreign Application Priority Data

Dec. 27, 2002 (JP) ..... 2002-380661

(51) Int. Cl.[7] ..... H05B 6/72

(52) U.S. Cl. ..... 219/749; 219/748; 219/695; 219/702; 219/711

(58) Field of Search ..... 219/748, 729, 219/746, 702, 711, 695, 756, 720, 715, 716

(56) References Cited

U.S. PATENT DOCUMENTS 4,327,266 A * 4/1982 Austin et al. ..... 219/749
4,568,811 A 2/1986 Yoshimura et al.
4,642,435 A 2/1987 Fitzmayer et al.
4,896,005 A * 1/1990 Skubich ..... 219/749
5,182,426 A 1/1993 Sklenak et al.
6,444,966 B2 * 9/2002 Mukumoto et al. ..... 219/749
2001/0017298 A1 8/2001 Mukumoto et al.

FOREIGN PATENT DOCUMENTS

| | | |
|---|---|---|
| EP | 1 083 772 A1 | 3/2001 |
| GB | 2 127 259 A | 4/1984 |
| JP | 56-115895 | 9/1981 |
| JP | 60-130094 | 7/1985 |

* cited by examiner

*Primary Examiner*—Philip H. Leung
(74) *Attorney, Agent, or Firm*—Foley & Lardner LLP

(57) ABSTRACT

A microwave oven has a heating chamber formed inside a body frame. A radiation antenna is provided below the heating chamber. The radiation antenna is structured in such a way that a member housed in an antenna drive box appropriately operates to change the distance between a bottom surface of the body frame and the radiation antenna. Microwaves generated by a magnetron are supplied through a waveguide and the radiation antenna into the heating chamber. When the level at which the radiation antenna is positioned is changed, the way to supply microwaves from the radiation antenna into the heating chamber is accordingly changed. Specifically, microwaves are locally supplied into the heating chamber or supplied uniformly into the whole of the heating chamber.

13 Claims, 18 Drawing Sheets

MICROWAVE OVEN CAPABLE OF CHANGING THE WAY TO SUPPLY MICROWAVES INTO HEATING CHAMBERS

BACKGROUND OF THE INVENTION

1. Field of the Invention

The present invention relates to cooking apparatuses. In particular, the present invention relates to a microwave oven capable of changing the way to supply microwaves into a heating chamber according to what is to be heated.

2. Description of the Background Art

Conventional microwave ovens have been known to have a magnetron to supply microwaves generated by the magnetron into a heating chamber containing a stuff to be heated and thereby heat the stuff.

An example of such microwave ovens is disclosed in Japanese Utility Model Laying-Open No. 56-115895, according to which the position of a radiation antenna is changed according to the shape of a stuff to be heated so as to change the position, in the direction of the height, where microwaves are concentrated, thereby preventing uneven heating.

Another example of such microwave ovens is disclosed in Japanese Patent Laying-Open No. 60-130094, according to which an antenna for supplying microwaves generated by a magnetron into a heating chamber is formed by bending a sheet metal and the antenna is rotated so as to avoid overheating of a central portion on the bottom of a heating chamber.

The above-described conventional microwave oven which changes only the height of the position where heating is concentratedly done, however, may or may not be able to satisfactorily address the multiplicity of the shape of a stuff to be heated.

Further, although it may be advantageous in some cases to avoid a central portion of the bottom of food from being concentratedly heated, the concentrated heating of the central portion may be appropriate in a particular case. In other words, the avoidance of the overheating of the central portion on the bottom of the heating chamber could be inappropriate depending on the type and shape of a stuff to be heated or depending on the state in which the stuff is placed in the heating chamber.

SUMMARY OF THE INVENTION

The present invention has been made in consideration of the above-described circumstances. An object of the present invention is to provide a microwave oven capable of changing the way to supply microwaves into a heating chamber according to what is to be heated.

A microwave oven according to the present invention includes a heating chamber holding food therein, a magnetron generating microwaves, a radiation antenna provided in the heating chamber for radiating the microwaves generated by the magnetron into the heating chamber, and an antenna moving unit moving the radiation antenna. The radiation antenna includes a first plane facing an inner wall of the heating chamber and a second plane facing the inner wall and located closer to the inner wall relative to the first plane. The first plane has an opening formed therein. The antenna moving unit is capable of moving the radiation antenna between a first position and a second position by changing the distance between the radiation antenna and the inner wall, the radiation antenna at the first position radiating the microwaves generated by the magnetron from an edge of the opening and the radiation antenna at the second position radiating the microwaves generated by the magnetron from respective edges of the first plane and the second plane.

According to the present invention, the distance between the radiation antenna and the inner wall can be changed by the antenna moving unit so as to change the impedance regarding microwaves in the space between the radiation antenna and the inner wall. Thus, by the antenna moving unit, the radiation antenna is allowed to supply microwaves from a part of the antenna into the heating chamber or to supply microwaves from the entire region of the antenna into the heating chamber.

In this way, the way to supply microwaves into the heating chamber of the microwave oven can be changed according to what is to be heated.

Preferably, regarding the microwave oven according to the present invention, the antenna moving unit rotates the radiation antenna.

Thus, when it is desired that the microwaves should be supplied into the whole of the heating chamber, microwaves can uniformly be supplied into the whole of the heating chamber.

Preferably, regarding the microwave oven according to the present invention, the antenna moving unit moves the radiation antenna between the first position and the second position while rotating the radiation antenna.

Thus, it rarely occurs that the radiation antenna is moved without being rotated, which reduces the cases in which users feel uneasy from the fact that no component is rotating.

Preferably, regarding the microwave oven according to the present invention, the antenna moving unit moves the radiation antenna in a predetermined manner before the magnetron starts generating microwaves.

Thus, generation of microwaves by the magnetron can be started after the radiation antenna is moved to an appropriate position. Accordingly, it can be avoided that microwaves are generated while the radiation antenna is placed at infinite number of positions between the first position and the second position and thus it can be avoided that an infinite number of electromagnetic-field-distribution patterns are present.

Preferably, regarding the microwave oven according to the present invention, the antenna moving unit stops the radiation antenna at a predetermined position when the magnetron completes its operation.

Thus, control for moving the radiation antenna is facilitated.

Preferably, the microwave oven according to the present invention further includes a switch turned on/off according to where the radiation antenna is positioned, the switch being turned off when the radiation antenna is at the predetermined position.

Thus, the period of time during which the switch is turned on can be shortened, which is advantageous for extension of the lifetime of the switch.

Preferably, regarding the microwave oven according to the present invention, the antenna moving unit stops the radiation antenna at the first position or the second position only.

Thus, control of the position of the radiation antenna by the antenna moving unit can be facilitated.

Preferably, the microwave oven according to the present invention further includes a number storing unit storing the number of times the radiation antenna has been stopped at the first position and the number of times the radiation antenna has been stopped at the second position. When the microwave oven is powered, the antenna moving unit stops the radiation antenna at one of the first position and the second position, at which the radiation antenna has been stopped a greater number of times which is stored in the storing unit.

Thus, the radiation antenna can efficiently be moved.

Preferably, the microwave oven according to the present invention further includes a number storing unit storing the number of times the radiation antenna has been stopped at the first position and the number of times the radiation antenna has been stopped at the second position. When the magnetron completes its operation, the antenna moving unit stops the radiation antenna at one of the first position and the second position, at which the radiation antenna has been stopped a greater number of times which is stored in the storing unit.

Thus, the radiation antenna can efficiently be moved.

Preferably, the microwave oven according to the present invention further includes an antenna position sensing unit detecting that the radiation antenna is at the first position and/or the second position. The antenna moving unit stops the radiation antenna from moving when no sensing output is obtained from the antenna position sensing unit even though the radiation antenna is moved for a predetermined time.

Thus, it can be avoided that certain operations for moving the radiation antenna are continued in spite of the fact that the radiation antenna is not normally moved.

Preferably, the microwave oven according to the present invention further includes a magnetron control unit controlling operation of the magnetron. The magnetron control unit stops the magnetron from generating microwaves when no sensing output is obtained from the antenna position sensing unit even though the antenna moving unit moves the radiation antenna for a predetermined time.

Thus, it can be avoided that certain operations for moving the radiation antenna are continued in spite of the fact that the radiation antenna is not normally moved.

Preferably, the microwave oven according to the present invention further includes a notifying unit providing a notification, when the antenna moving unit stops movement of the radiation antenna, that the antenna moving unit stops the radiation antenna from moving for the reason that no sensing output is obtained from the antenna position sensing unit.

Thus, a user can easily know the fact that the radiation antenna is not normally moved.

Preferably, the microwave oven according to the present invention further includes a magnetron control unit controlling operation of the magnetron. The magnetron control unit allows the magnetron to generate microwaves on the condition that the radiation antenna is stopped at the first position or the second position.

Thus, the way to supply microwaves into the heating chamber of the microwave oven is accurately controlled.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
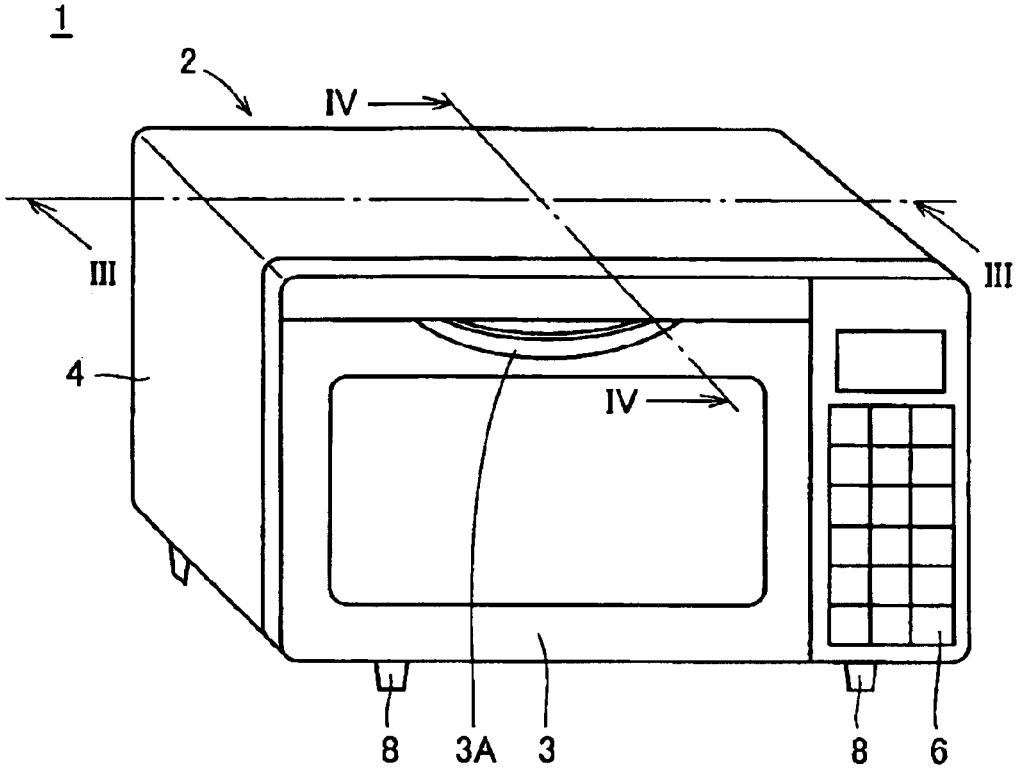
FIG. 1 is a perspective view of a microwave oven according to an embodiment of the present invention.

A microwave oven is hereinafter described in connection with the drawings according to an embodiment of the present invention. Like components in the drawings are denoted by like reference characters and have the same names and the same functions, except for a particular case which is specifically noted. Accordingly, detailed description thereof is not repeated here.

Referring to FIG. 1, microwave oven 1 is mainly constituted of a body 2 and a door 3. The exterior of body 2 is covered with an outer jacket 4. Further, on the front surface of body 2, a control panel 6 is provided for allowing a user to enter various information to microwave oven 1. Body 2 is supported by a plurality of legs 8.

Door 3 is structured to be openable/closable on the lower end. Door 3 has its upper part provided with a handle 3A.

Figure 2:
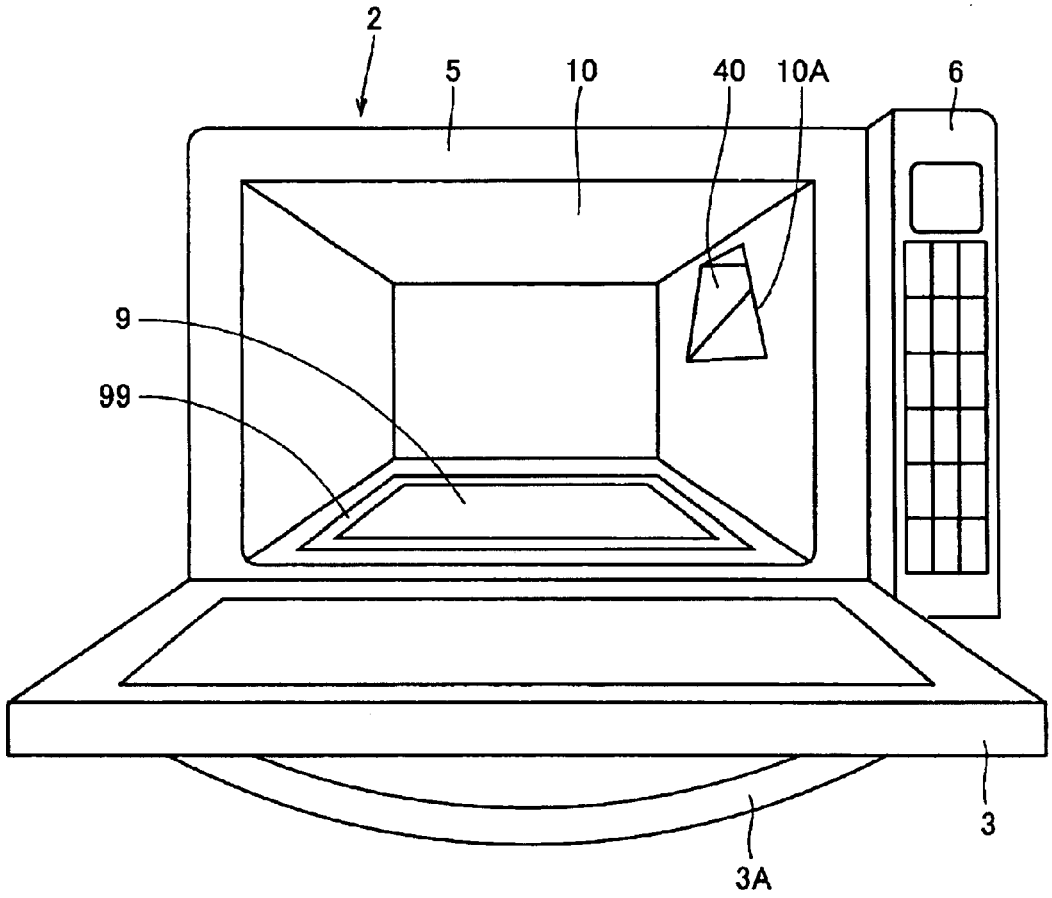
FIG. 2 is a front view of the microwave oven shown in FIG. 1 with its door opened.

FIG. 2 is a front view of microwave oven 1 as seen from the front with door 3 opened.

Referring to FIG. 2, a body frame 5 is provided within body 2. A heating chamber 10 is provided inside body frame 5. A recess 10A is formed in an upper part of the right side of heating chamber 10. A sensing route member 40 is connected to recess 10A from the outside of heating chamber 10. A bottom plate 9 is placed on the bottom of heating chamber 10.

Figure 3:
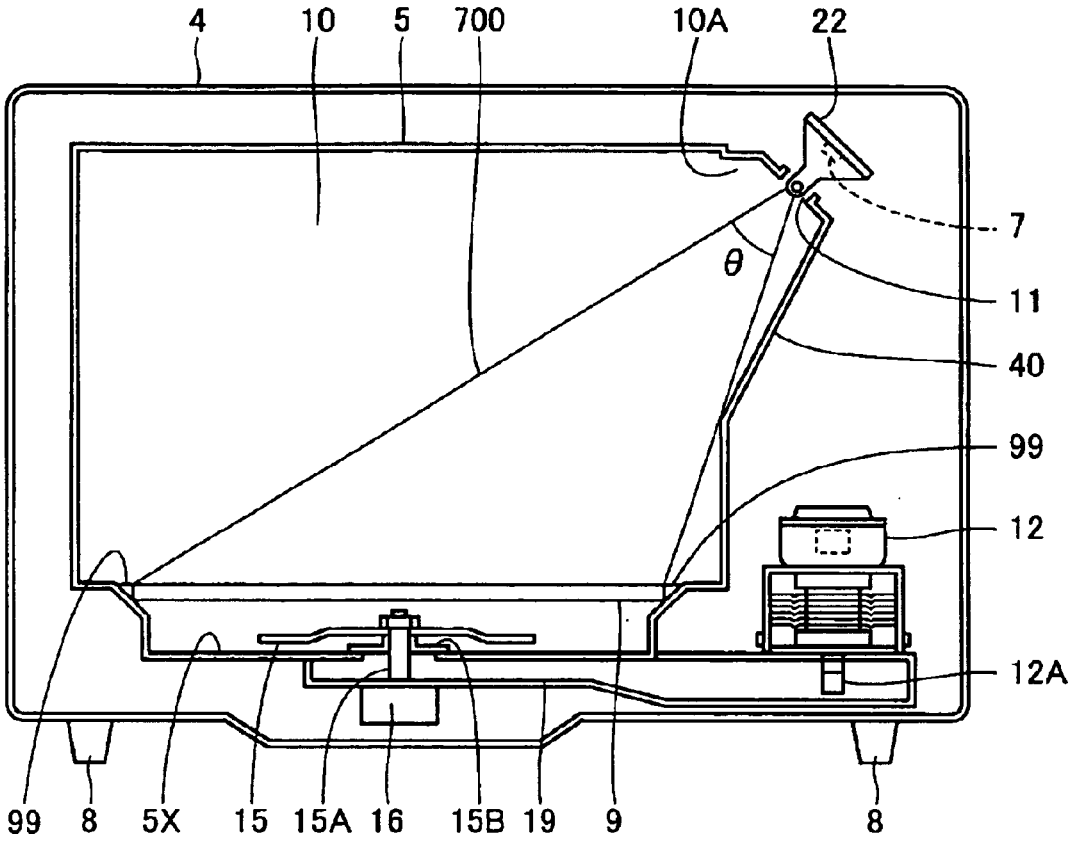
FIG. 3 is a cross-sectional view along line III—III in FIG. 1.
Figure 4:
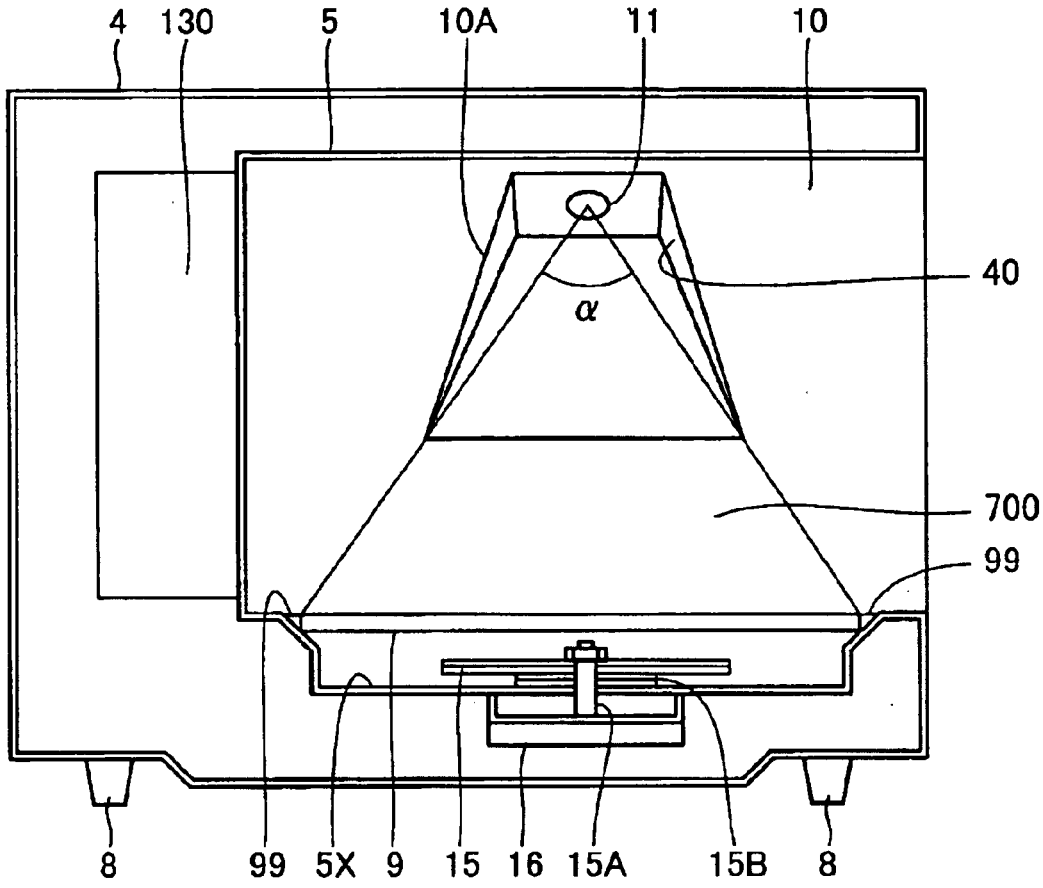
FIG. 4 is a cross-sectional view along line IV—IV in FIG. 1.

FIG. 3 is a cross-sectional view along line III—III in FIG. 1, and FIG. 4 is a cross-sectional view along line IV—IV in FIG. 1.

Referring to FIGS. 3 and 4, sensing route member 40 connected to recess 10A is in the shape of a box and has an opening which is connected to recess 10A. An infrared sensor 7 is attached to the "bottom" of the box-shaped sensing route member 40. Infrared sensor 7 has a sensing hole for receiving infrared radiation. Further, a sensing window 11 is formed in the "bottom" of the box-shaped sensing route member 40 to face the sensing hole of infrared sensor 7.

Infrared sensor 7 has its field of view 700 within heating chamber 10. Infrared sensor 7 is turned at an angle $\theta$ in the direction of the width and turned at an angle $\alpha$ in the direction of the depth such that field of view 700 covers the whole of the bottom surface of heating chamber 10.

A magnetron 12 is provided within outer jacket 4 to be adjacent to and on the lower right side of heating chamber 10. A waveguide 19 is provided under heating chamber 10 for connecting magnetron 12 to a lower part of body frame 5. Magnetron 12 has a magnetron antenna 12A located within waveguide 19. Magnetron 12 emits microwaves from magnetron antenna 12A and the microwaves are supplied into heating chamber 10 via waveguide 19.

A radiation antenna 15 is provided between a bottom surface 5X of body frame 5 and bottom plate 9. An antenna drive box 16 is provided under waveguide. 19 for controlling movements, for example, rotations of radiation antenna 15. Radiation antenna 15 is connected by a shaft 15A to antenna drive box 16. An attachment 15B is provided for attaching shaft 15A to body frame 5. Radiation antenna 15 is thus attached by attachment 15B and shaft 15A to body frame 5 such that antenna 15 is horizontally rotatable. Shaft 15A serves to couple waveguide 19 to heating chamber 10 in terms of microwaves.

A silicon 99 is provided along the periphery of bottom plate 9. Silicon 99 serves to seal the periphery of bottom plate 9.

Food is placed on bottom plate 9 within heating chamber 10. Microwaves generated by magnetron 12 are passed through waveguide 19 to be supplied into heating chamber 10 while being diffused by radiation antenna 15. The food on bottom plate 9 is accordingly heated.

A heater unit 130 is provided behind heating chamber 10. Heater unit 130 houses a heater as well as a fan for efficiently sending heat generated by the heater into heating chamber 10.

Figure 5:
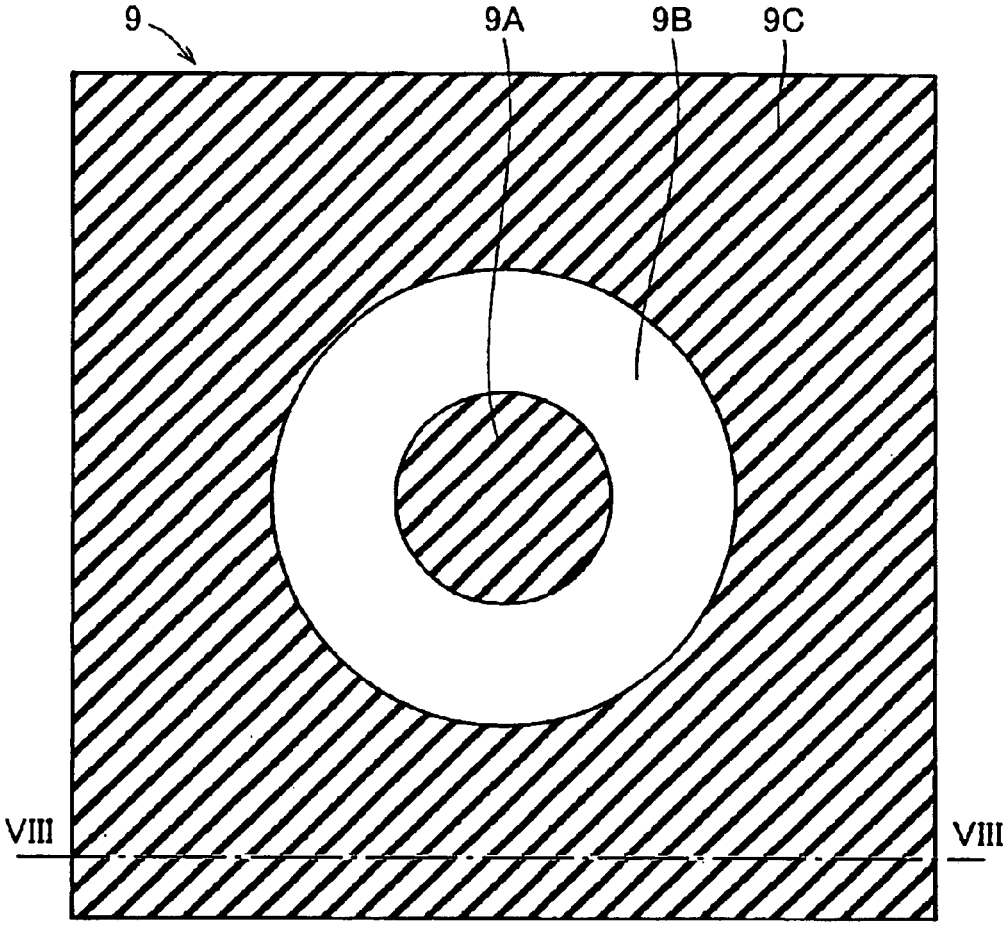
FIG. 5 is a plan view of a bottom plate of the microwave oven shown in FIG. 1.

Bottom plate 9 of microwave oven 1 is structured as detailed below in connection with to FIG. 5. FIG. 5 is a plan view of bottom plate 9.

Bottom plate 9 is made of a transparent glass having its surface partially printed. In FIG. 5, the printed parts of bottom plate 9 are indicated by diagonal lines. More specifically, bottom plate 9 includes a circular printed region 9A at the central part thereof that is filled in with black. A doughnut-shaped transparent region 9B which is not printed is located around printed region 9A. Further, a printed region 9C which is filled in with black is provided around transparent region 9B. Bottom plate 9 is printed in the above-described manner so that such an aesthetic nuisance as attachment 15B, which is provided for attaching radiation antenna 15 and has no direct relation with cooking, can be put out of sight. Specifically, the central printed region of the bottom plate can be displaced forward slightly (approximately 10 mm) from the center of the bottom plate so that the antenna attachment at the center of the bottom frame is efficiently made invisible from a user, which is detailed below in connection with FIGS. 6 and 7.

Figure 6:
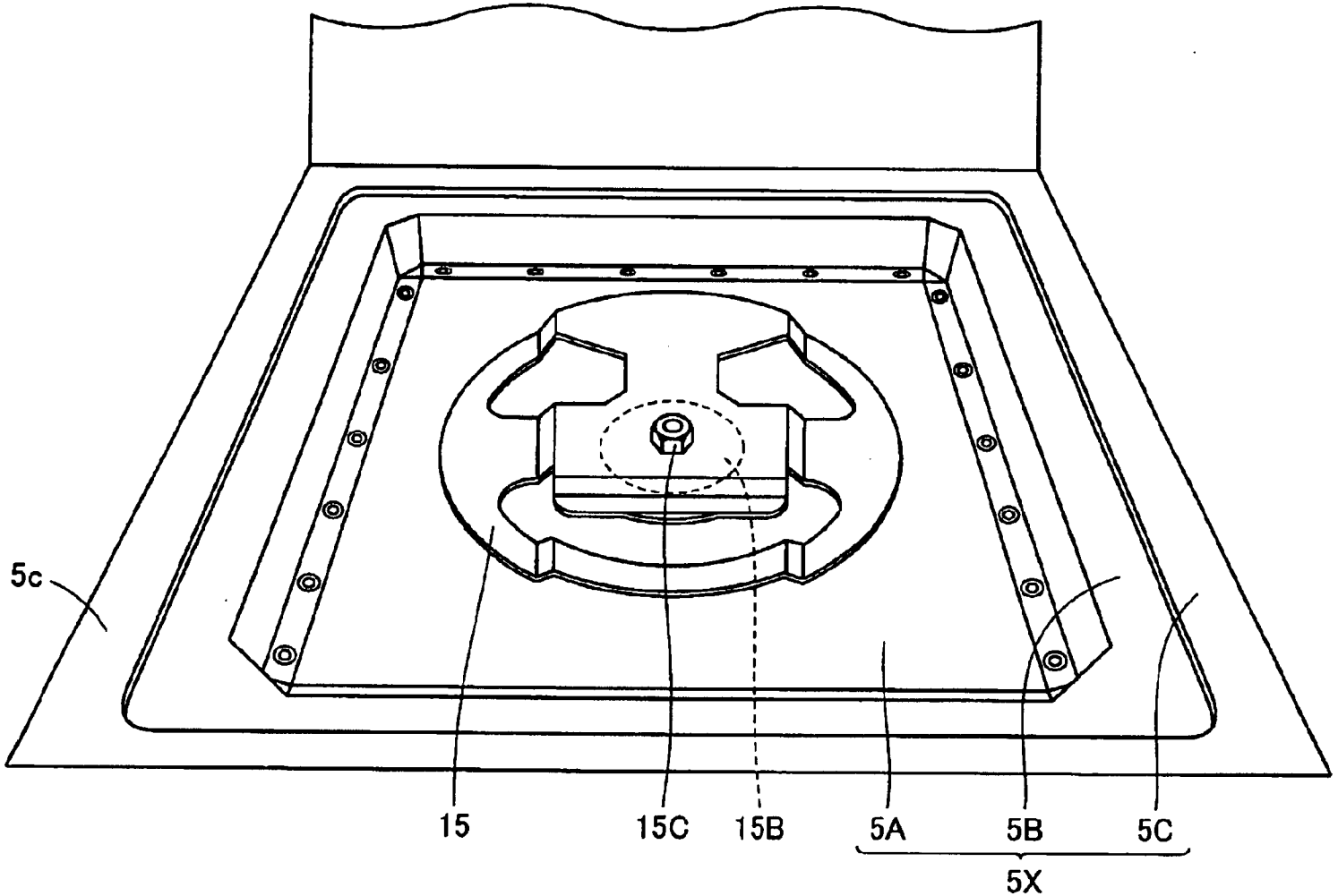
FIG. 6 shows a bottom surface of a body frame with the bottom plate detached from the microwave oven shown in FIG. 1.
Figure 7:
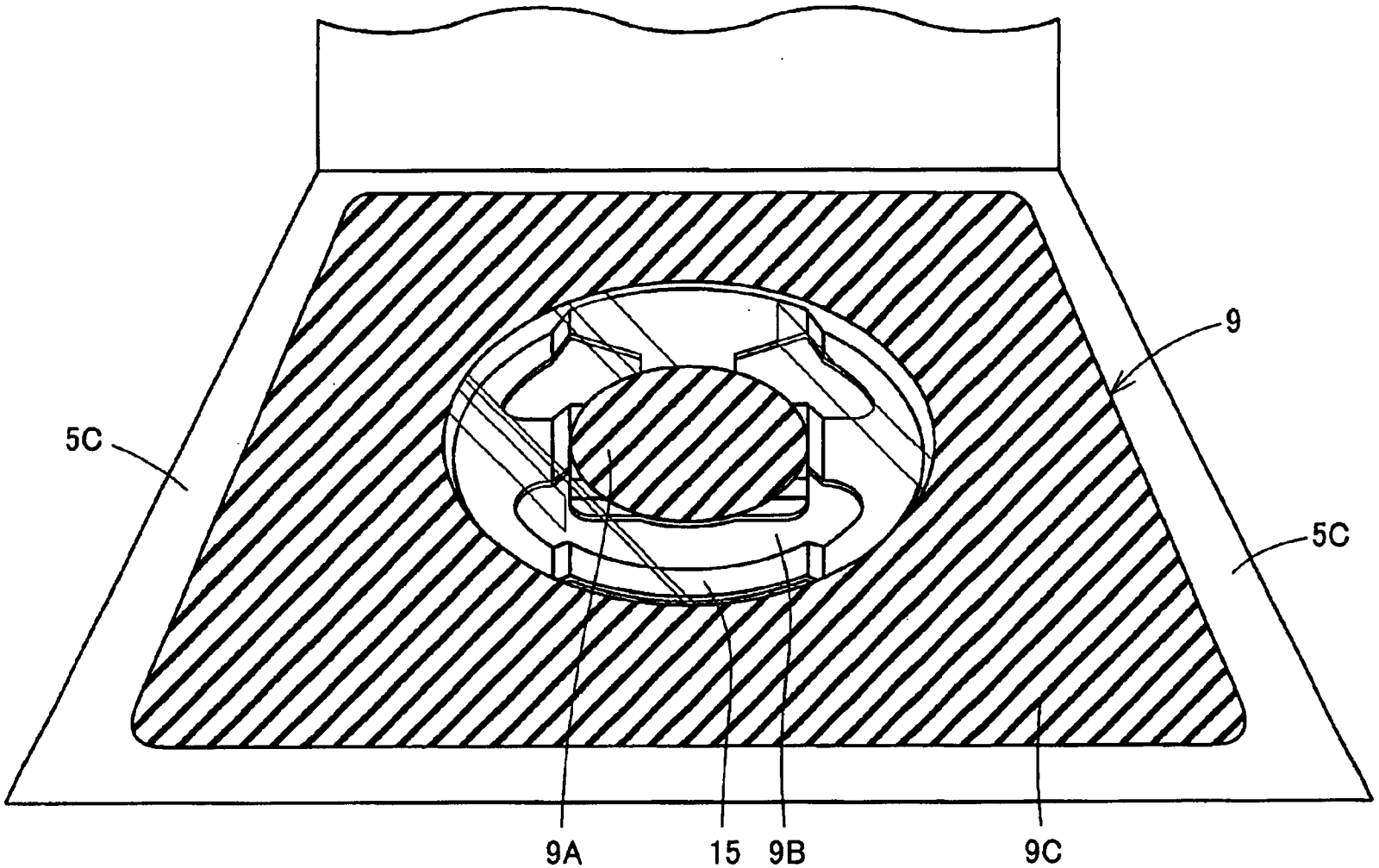
FIG. 7 shows a bottom surface of a heating chamber of the microwave oven in FIG. 1.

FIG. 6 shows the bottom surface of body frame 5 as seen diagonally from the front and above, with door 3 opened and with bottom plate 9 detached. FIG. 7 shows the bottom surface of the heating chamber 10 as seen diagonally from the front and above with bottom plate 9 attached. The printed regions on bottom plate 9 are indicated by diagonal lines in FIG. 7.

Referring first to FIG. 6, radiation antenna 15 in the shape of a disk has a plurality of openings formed therein. A washer 15C is attached on the center of radiation antenna 15 so as to connect radiation antenna 15 to shaft 15A. Radiation antenna 15 rotates about washer 15C on a horizontal plane.

Bottom surface 5X of body frame 5 has a concave portion 5A formed therein. A bottom plate support 5B corresponding to a perimeter region of bottom plate 9 (perimeter region refers to an outermost portion of bottom plate 9 that has a width of approximately 2–3 cm) is formed along the periphery of concave portion 5A. Bottom plate support 5B is at a level lower approximately by the thickness of bottom plate 9 with respect to an outermost portion 5C located outside bottom plate support 5B. Accordingly, bottom plate 9 and outermost portion 5C are coplanar when bottom plate 9 is attached in such a manner that the perimeter region of bottom plate 9 corresponds to bottom plate support 5B.

Radiation antenna 15 is attached nearly at the center of concave portion 5A. When a user sees heating chamber 10 with bottom plate 9 detached, the user can see radiation antenna 15, attachment 15B and washer 15C for example. In this case, the user can also see, for example, drain holes, seams of sheet metals and a plurality of screws attached to the seams that are located on the perimeter region of concave portion 5A.

Referring next to FIG. 7, as bottom plate 9 is attached to the bottom surface of heating chamber 10, attachment 15B, washer 15C as well as the seams and the screws on the seams that are located on the perimeter region of concave portion 5A are hided by printed regions 9A and 9C and thus invisible from the above of bottom plate 9. With bottom plate 9 attached, however, the perimeter region of radiation antenna 15 can be seen through transparent region 9B from the above of bottom plate 9. The invisible portion of radiation antenna 15 that is shielded by printed region 9A corresponds to a circular region extending from the center of radiation antenna 15 with its perimeter located at a half of the radius of radiation antenna 15. The perimeter of transparent region 9B as seen in FIG. 7 substantially matches the perimeter of radiation antenna 15 within the field of view of the user, since the center of transparent region 9B is displaced forward by approximately 10 mm.

Bottom plate 9 of microwave oven 1 as described above has transparent region 9B. Rotations of radiation antenna 15 are thus visible from the above of bottom plate 9. Therefore, when radiation antenna 15 is out of order for example and accordingly remains stopping in situations where the radiation antenna has to rotate, the failure of the antenna can be found in early stages.

Radiation antenna 15 of microwave oven 1 in this embodiment is placed in the lower part of heating chamber 10, and accordingly transparent region 9B is provided to bottom plate 9 corresponding in position to the bottom of heating chamber 10. Then, if radiation antenna 15 is placed on one of the lateral sides of heating chamber 10, the sidewall of heating chamber 10 may be structured of a plate member having a transparent region through which rotations of radiation antenna 15 are visible.

Moreover, such a microwave oven 1 having radiation antenna 15 placed on the bottom surface of heating chamber 10 can avoid uneven heating to some degree in cooking operations by means of magnetron 12, without moving food to be heated by moving a turn table for example. Namely, such a turn table as the one which is provided in the commercially available microwaves is unnecessary for this microwave oven 1. This causes, however, certain uneasiness to a user since the user can see no component which is rotating within the heating chamber and thus doubts whether or not cooking is sufficiently or appropriately done. Then, microwave oven 1 has transparent region 9B to allow rotations of radiation antenna 15 to be visible from the user, which can assure the user of the fact that there is a rotating component in heating chamber 10 in cooking operations.

Further, bottom plate 9 is partially printed for the purpose of blocking view. Then, aesthetically displeasing components can be made invisible from the user in cooking operations.

Preferably, the printing on bottom plate 9 is made slightly (approximately 10 mm) ahead of the region directly above the components to be hided that are mounted on concave portion 5A. From the region where the components to be hided are located, the printed region of bottom plate 9 for hiding these components is displaced in the manner as described above since users see bottom plate 9 from the front of heating chamber 10. In other words, the components that should be made invisible and the printing on bottom plate 9 are displaced with respect to the vertical direction so that the printing is appropriately and surely matched with the components to be hided.

Bottom plate 9 is formed of a transparent plate as described above. A material for bottom plate 9 preferably has a high heat resistance (temperature), a high thermal shock resistance, a low dielectric loss and a high strength. If the heat resistance (temperature) is not high, bottom plate 9 could be broken when food is heated.

If the thermal shock resistance is not high, bottom plate 9 could be broken under the situation that bottom plate 9 is increased in temperature since a certain food stuff has been heated on the plate and then the next cold food stuff to be heated is placed on bottom plate 9. Here, thermal shock resistance refers to a property evaluated by a value which is calculated when a certain material is put in cold water after being heated by an oven for example, and specifically refers to a temperature difference which the material can endure. For example, referring to Table 1 which is hereinlater described, a thermal shock resistance of 100° C. means that a material which is put in water of 10° C. after being heated to 110° C. is not broken.

If the dielectric loss is high, microwaves generated by magnetron 12 could be absorbed by bottom plate 9, resulting in deterioration in heating efficiency.

If the strength is low, bottom plate 9 could be broken when food is placed on bottom plate 9.

The above-described properties that are required as those of a material for bottom plate 9 are similarly required even in a case that the radiation antenna is provided on any side of the heat chamber (e.g. top, lateral side) except for the bottom side and a plate member corresponding to bottom plate 9 is provided to cover this radiation antenna. The reason therefor is that, regarding the heat resistance (temperature) and the thermal shock resistance, a food stuff being heated could be spattered over a sidewall for example of the heating chamber due to any inappropriate handling by a user. Regarding the dielectric loss, the reason therefor is that microwaves could be absorbed by any component within the heating chamber, for example, by the bottom, the sidewall, or the ceiling. Regarding the strength, the reason therefor is that a vessel for example that holds the food could bump against the sidewall for example of the heating chamber due to any inappropriate handling by a user.

An example of materials having the above-described properties is borosilicate glass. In particular, toughened borosilicate glass is preferred. Table 1 shows properties of examples of the toughened borosilicate glass, namely, toughened glass Pyrex (registered) and toughened glass Tempax Float (registered). Table 1 further shows properties of toughened soda glass, Neoceram (registered) and cordierite. Neoceram (registered) and cordierite, however, are used for a pan-holding plate of an electromagnetic cooker and are opaque. Therefore, these materials are inappropriate for bottom plate 9 of microwave oven 1.

TABLE 1

| | glass | | | | |
|---|---|---|---|---|---|
| properties | Pyrex ®, toughened | Tempax Float ®, toughened | soda glass, toughened | Neoceram ® | cordierite |
| heat resistance (° C.) | 290 | 280 | 250 | 850 | 1200 |
| thermal shock resistance (° C.) | 304 | 280 | 220 | 600 | 250 |
| dielectric loss ($x10^{-4}$) | 50 | 37 | — (~100) | 260 | 53 |
| flexural strength ($N/mm^2$) | 70 | 110 | 100 | 170 | 150 |

With reference to Table 1, the toughened glass Pyrex (registered) and the toughened glass Tempax Float registered) that are borosilicate glasses are substantially comparable in terms of strength (flexural strength) to Neoceram (registered) and cordierite. In addition, Pyrex (registered) and Temp ax Float (registered) are considerably lower than Neoceram (registered) and lower than cordierite in terms of dielectric loss.

The toughened glass Pyrex (registered) and the toughened glass Tempax Float (registered) are almost equal in terms of strength (flexural strength) to toughened soda glass which is a transparent glass. Further, the toughened glass Pyrex (registered) and the toughened glass Tempax Float (registered) are higher in heat resistance (temperature) than the toughened soda glass by 40° C. and 30° C. respectively, and higher in thermal shock resistance by 84° C. and 60° C. respectively. Although the dielectric loss of the toughened soda glass is not shown in Table 1, the dielectric loss thereof is supposed to be approximately $100\times10^{-4}$. In other words, the toughened glass Pyrex (registered) and the toughened glass Tempax Float (registered) are considerably lower in dielectric loss than the toughened soda glass.

It is seen from the above that a material for bottom plate 9 is preferably borosilicate glass and, in particular, toughened borosilicate glass.

Figure 8:
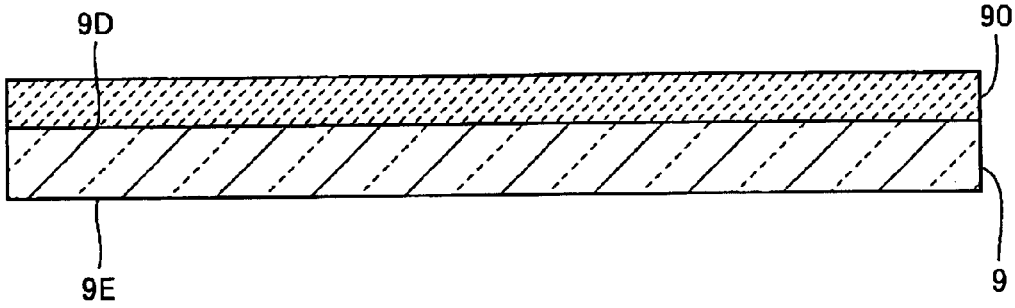
FIG. 8 is a cross-sectional view along line VIII—VIII in FIG. 5.

Printing is made on one side of bottom plate 9. In general, when printing is made on one side of a plate-like member, ink enters fine cracks in the printed surface to penetrate deeper. Then, when any force is exerted on the side opposite to the printed side, the force acts in the direction in which the cracks expand, resulting in a decrease in strength, which is hereinafter described in detail in connection with FIG. 8. FIG. 8 is a cross-sectional view along line VIII—VIII in FIG. 5.

Bottom plate 9 has a printed front side 9D and a rear side 9E opposite to printed side 9D. Ink 90 is applied onto printed side 9D. In this case, the strength of ink-applied printed side 9D against shock from rear side 9E is lower than that of front side 9D onto which ink 90 has not been applied.

Further, since the printing on printed side 9D is made in the manner as shown in FIG. 5, the surface of printed side 9D includes an ink-applied region and a region to which no ink is applied. Accordingly, the degree of unevenness of the surface of printed side 9D is higher than that of rear side 9E.

When bottom plate 9 is attached in heating chamber 10 as shown in FIG. 2 for example, printed surface 9D may face upward or face downward. In the former case, food contacts printed side 9D. In the latter case, food contacts rear side 9E.

It is advantageous to attach bottom plate 9 in such a manner that food contacts printed side 9D, in that the strength of the side which is in contact with the food in microwave oven 1 can be ensured, and further, in that the uneven surface which is in contact with food is less slippery so that food on bottom plate 9 is unlikely to slide and thus safety is ensured.

On the contrary, if bottom plate 9 is attached in such a manner that food contacts rear side 9E, the less uneven side on which food is placed in microwave oven 1 advantageously facilitates cleaning of this side, which is sanitarily preferable.

Preferably, the side of bottom plate 9 on which food is placed is processed so that the side is rough enough to provide an anti-slip surface of bottom plate 9. This surface finish may be done by spreading a material for bottom plate 9 by a roller. Accordingly, some unevenness like embossing on the surface of the roller is transferred to the surface of bottom plate 9. The unevenness of the roller thus makes rough the surface of bottom plate 9.

Figure 9:
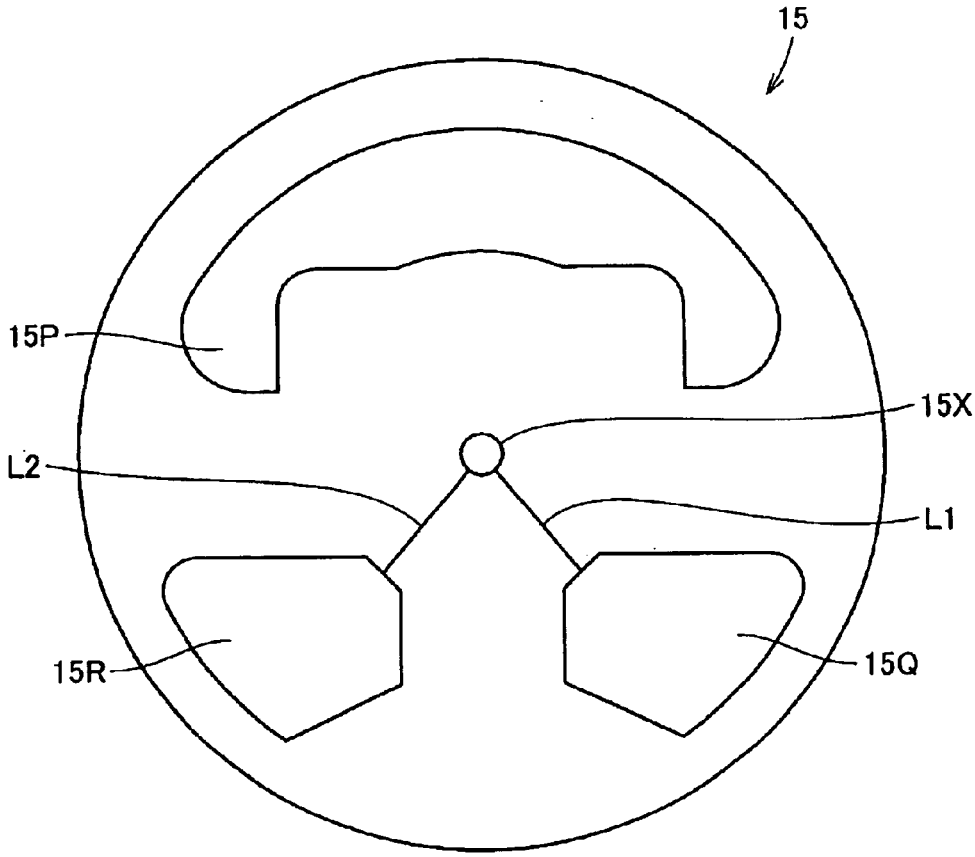
FIG. 9 is a plan view of a radiation antenna in FIG. 3.

FIG. 9 is a plan view of radiation antenna 15. In radiation antenna 15, a hole 15X through which shaft 15A is passed as well as openings 15P, 15Q and 15R are formed. In FIG. 9, the shortest path between opening 15Q and hole 15X is represented by line L1 and the shortest path between opening 15R and hole 15X is represented by line L2. Line L1 and line L2 each have a length of approximately 45 mm.

Figure 10:
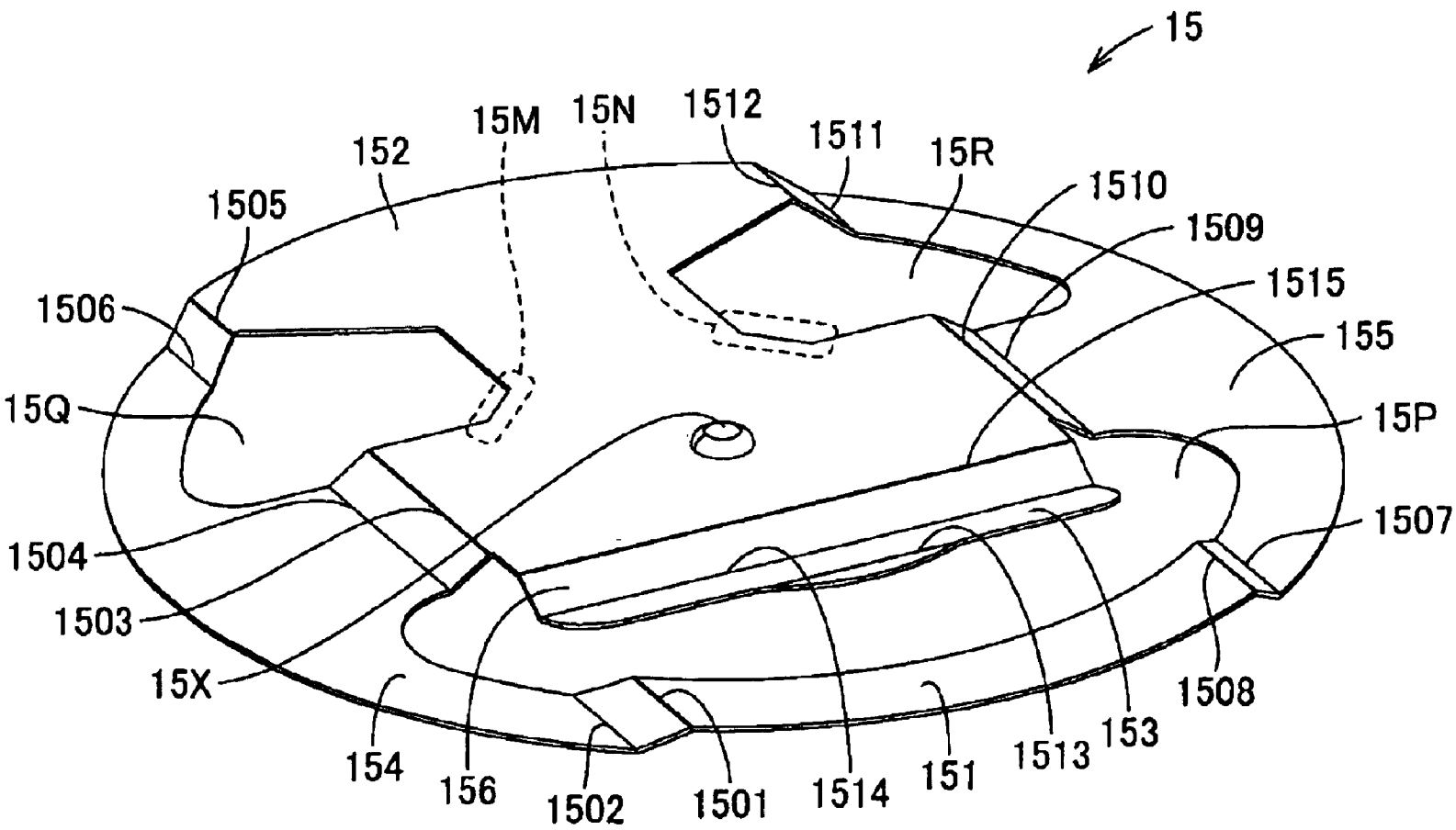
FIG. 10 is a perspective view of the radiation antenna in FIG. 3.
Figure 11:
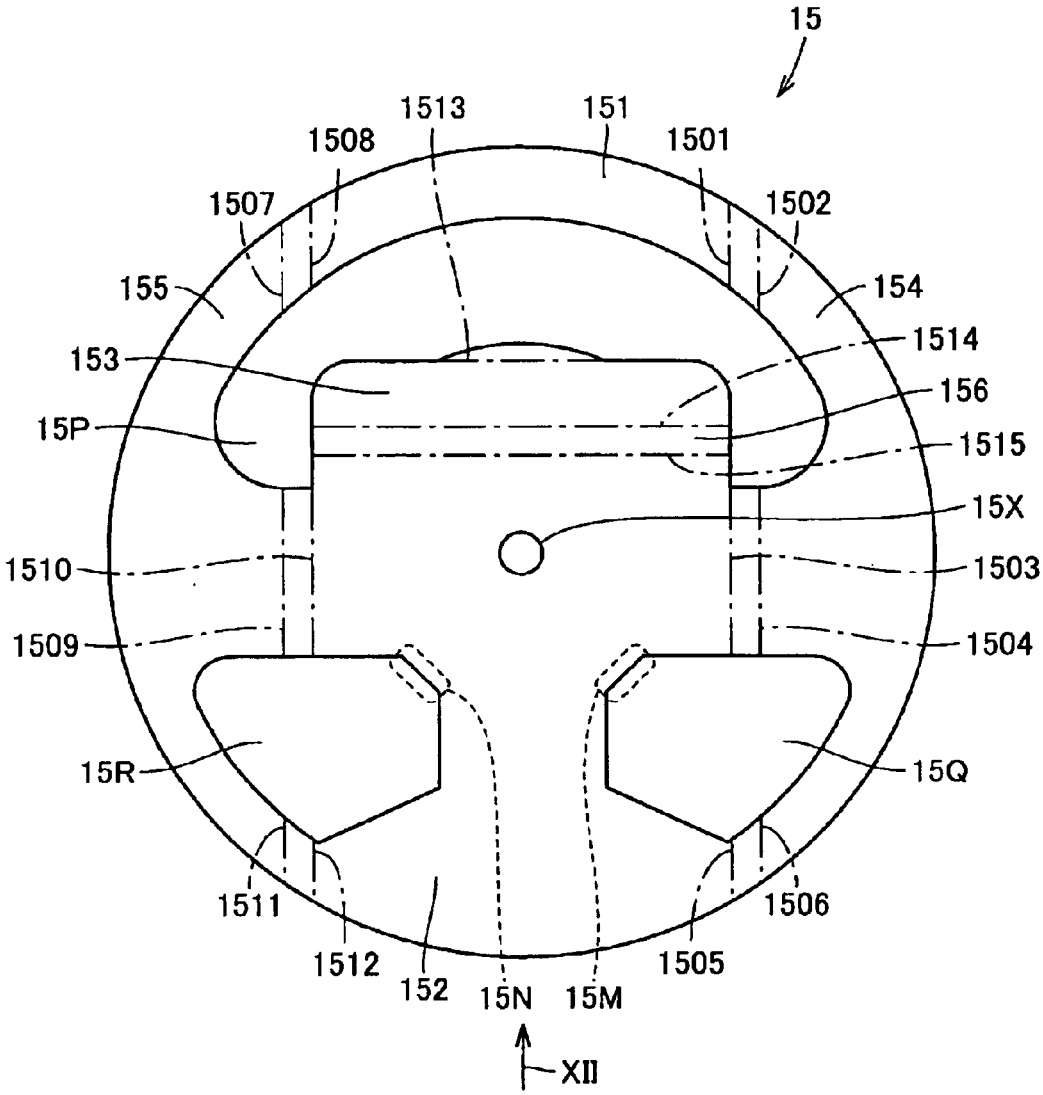
FIG. 11 is a plan view of the radiation antenna in FIG. 3, showing lines at which the radiation antenna is bent.
Figure 12:
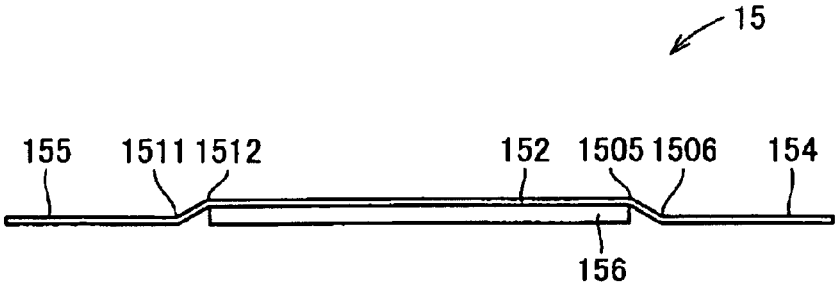
FIG. 12 is a side view, as seen in the direction indicated by arrow XII, of the radiation antenna in FIG. 11.

Radiation antenna 15 is structured as detailed below. FIG. 10 is a perspective view of radiation antenna 15. As seen from FIG. 10, radiation antenna 15 has a bent structure. FIG. 11 is a plan view of radiation antenna 15 showing lines at which the antenna is bent. FIG. 12 is a side view of radiation antenna 15 as seen in the direction of the arrow indicated by XII in FIG. 11.

Radiation antenna 15 is bent downward along lines 1501, 1503, 1505, 1508, 1510 and 1512 so that one of the portions located on respective sides with respect to the line along which the antenna is bent downward that is located farther from hole 15X relative to the other portion is at a lower level than the one portion. Radiation antenna 15 is then bent upward along lines 1502, 1504, 1506, 1507, 1509 and 1511 which are located farther from hole 15X relative to the first-mentioned lines so that one of the portions located on respective sides with respect to the line along which the antenna is bent upward that is located farther from hole 15X relative to the other portion is made parallel to the original plane. Radiation antenna 15 bent along lines 1501–1512 as described above accordingly has planes 151 and 152 at the same level as well as planes 154 and 155 at a lower level relative to planes 151 and 152. Further, radiation antenna 15 is mountain folded along a line 1515, valley folded along a line 1514 and then mountain-folded along a line 1513. Accordingly, radiation antenna 15 has a plane 156 between lines 1515 and 1514 and a plane 153 between lines 1514 and 1513.

Figure 13:
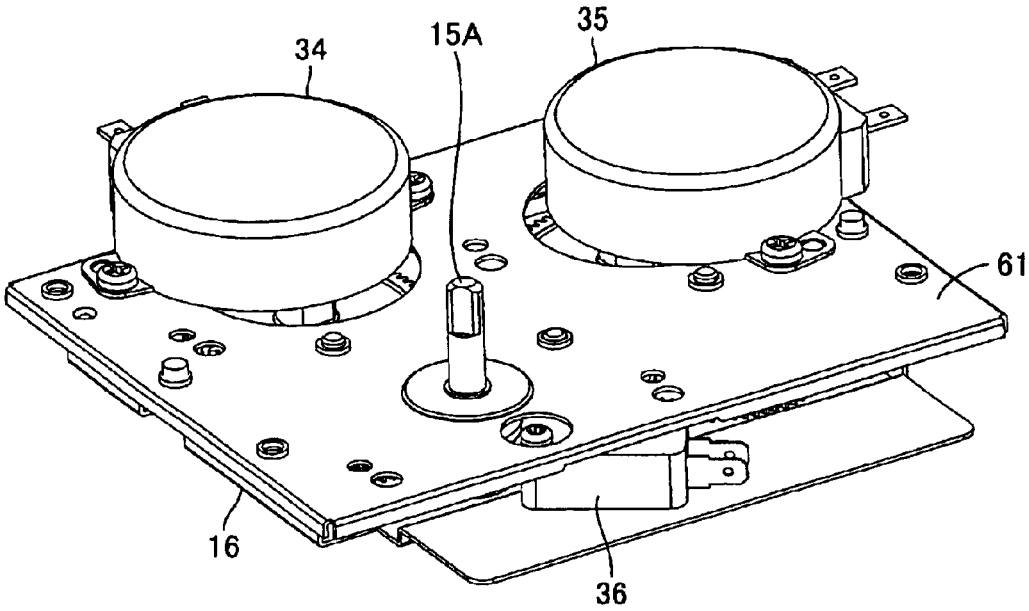
FIG. 13 is a perspective view of an antenna drive box and components therearound.

Next, a mechanism for driving radiation antenna 15, including components within antenna drive box 16 is described. FIG. 13 is a perspective view of antenna drive box 16 and members therearound. A table 61 is mounted on antenna box 16 to cover it. Shaft 15A stands upright to pass through table 61. An antenna rotation motor 34 and an antenna up/down drive motor 35 (not shown in FIG. 3) are provided on table 61 and below waveguide 19. Antenna rotation motor 34is driven for rotating radiation antenna 15 on a horizontal plane. Antenna up/down drive motor 35 is driven for moving radiation antenna 15 upward/downward.

Figure 14:
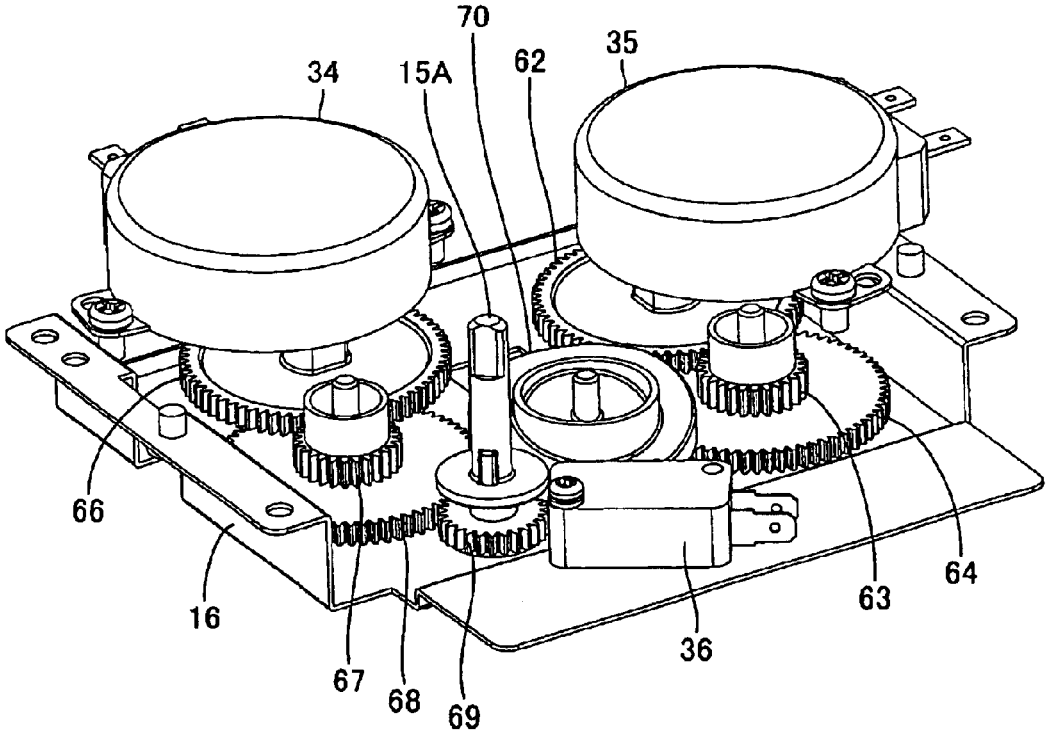
FIG. 14 is similar to FIG. 13 except that a table is not shown.
Figure 15:
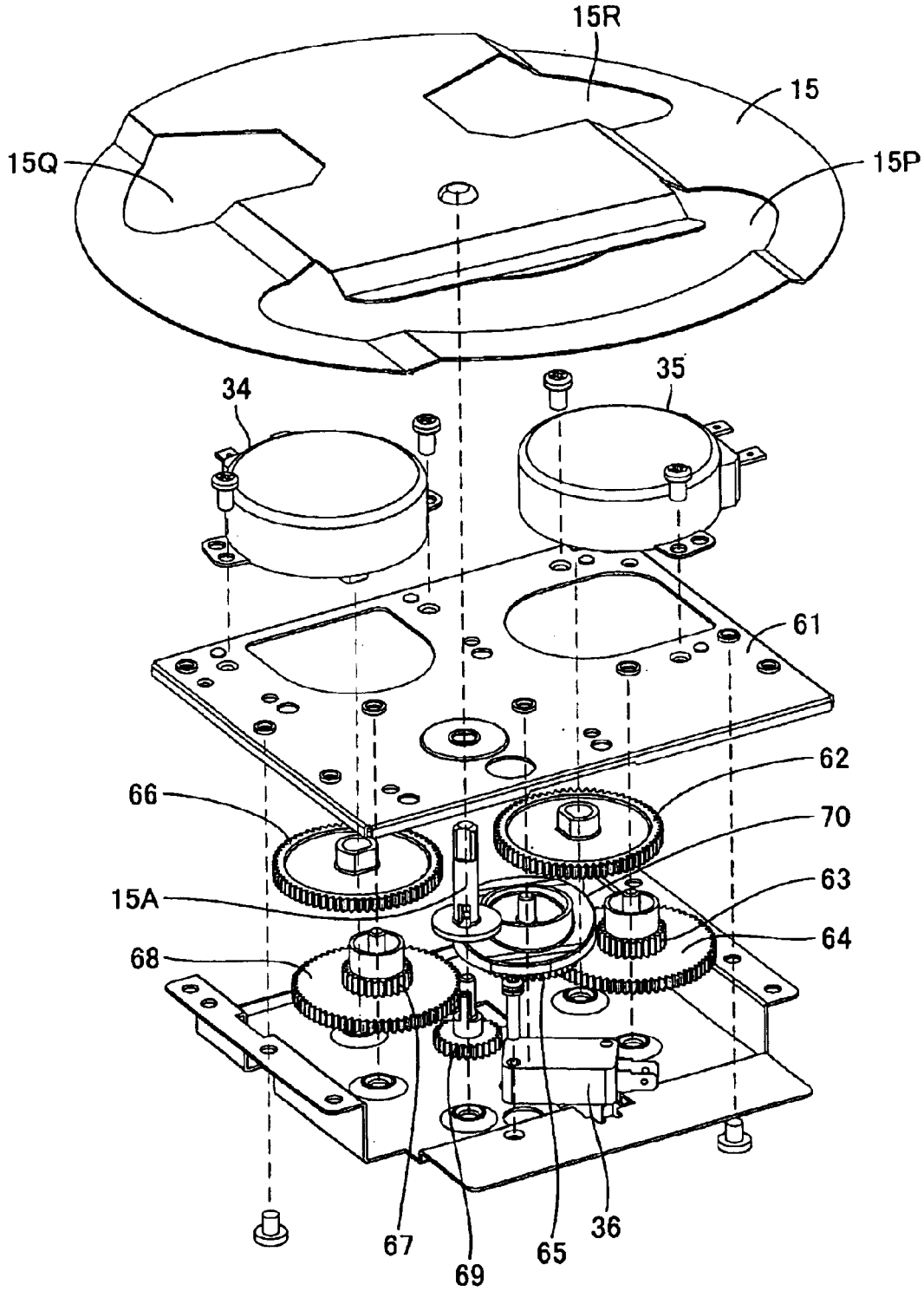
FIG. 15 is an exploded perspective view of the antenna drive box, the table, an antenna rotation motor, an antenna up/down drive motor and the radiation antenna that are to be assembled.

Various components including an antenna sensing switch 36 are provided within antenna drive box 16 and below table 61. FIG. 14 is similar to FIG. 13 except that table 61 is not shown in FIG. 14. FIG. 15 is an exploded perspective view of antenna drive box 16, table 61, antenna rotation motor 34, antenna up/down drive motor 35 and radiation antenna 15 that are to be assembled.

A plurality of gears 62–69 are rotatably attached within antenna drive box 16.

Antenna rotation motor 34 is driven so that gear 66 connected to this motor rotates. Rotations of gear 66 cause rotations of gear 68 engaging with gear 66. Rotations of gear 68 cause rotations of gear 67 integrally formed with gear 68. Rotations of gear 67 cause rotations of gear 69 engaging with gear 67. Rotations of gear 69 cause rotations of shaft 15A attached to gear 69. Then, rotations of shaft 15A cause rotations of radiation antenna 15.

A rotation member 70 attached to an upper part of gear 65 is tubular and has an elliptical cross section, and the rim of rotation member 70 is not at the same level, i.e., the height of the rim varies depending on the regions of the rim. Shaft 15A is supported from below by the rim of rotation member 70.

Antenna up/down drive motor 35 is driven so that gear 62 connected to this motor rotates. Rotations of gear 62 cause rotations of gear 63 engaging with gear 62. Rotations of gear 63 cause rotations of gear 64 integrally formed with gear 63. Rotations of gear 64 cause rotations of gear 65 engaging with gear 64. Rotations of gear 65 cause rotations of rotation member 70. As rotation member 70 rotates, shaft 15A is supported at different levels by rotation member 70.

Figure 16:
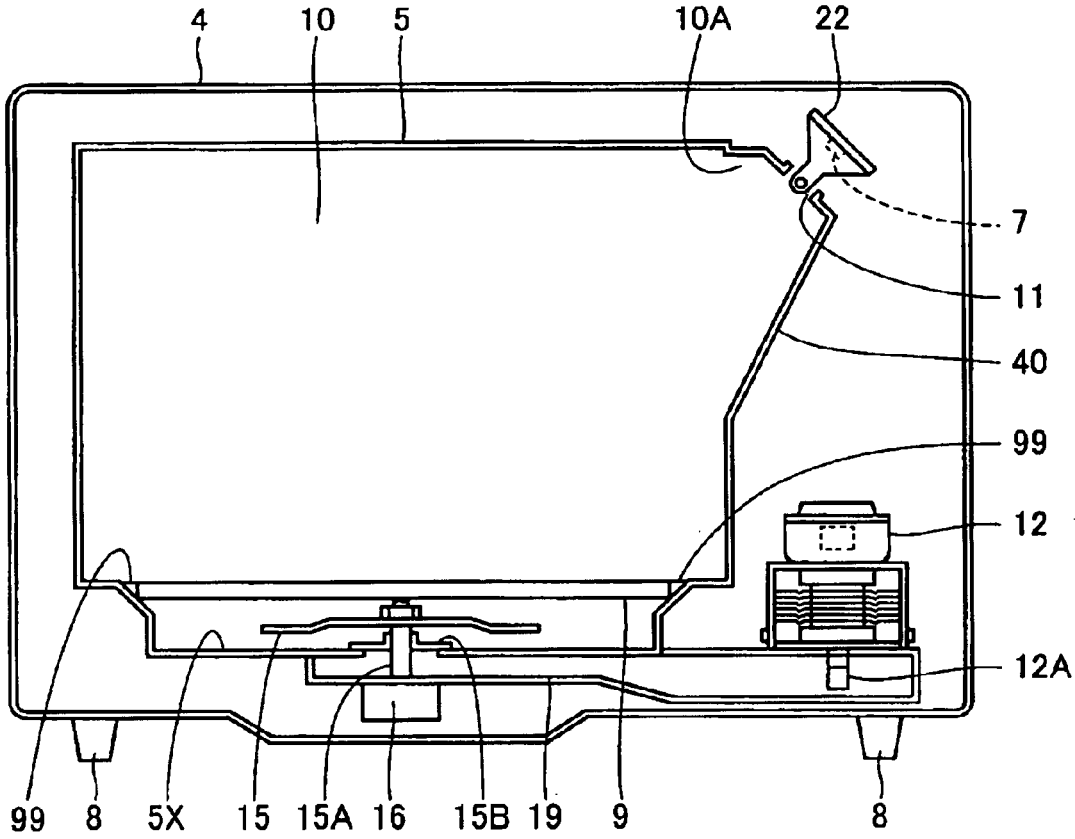
FIG. 16 shows a state of the radiation antenna placed at a higher level relative to the state shown in FIG. 3.

As the level at which shaft 15A is supported by rotation member 70 varies, the level of radiation antenna 15 accordingly changes. Specifically, radiation antenna 15 at a certain level as shown in FIG. 3 for example is moved upward as the level at which shaft 15A is supported by rotation member 70 is changed as shown in FIG. 16. In microwave oven 1, during the period in which rotations of rotation member 70 are continued, the level of radiation antenna 15 continuously changes as well.

Regarding radiation antenna 15 as described in connection with FIG. 9, lines L1 and L2 connect hole 15X connected to shaft 15A and respective ends of openings 15Q and 15R respectively. For microwave oven 1 in the state as shown in FIG. 3, the sum X of the distance over which microwaves are transmitted through shaft 15A and the length of line L1 or L2 is represented by formula (1) where λ indicates the wavelength of microwaves generated by magnetron 12 and n is an integer:

$$X=n\times\lambda/2 \quad (1).$$

In the state shown in FIG. 3, the distance between radiation antenna 15 and bottom surface 5X of body frame 5 is relatively short and accordingly the impedance in the space between radiation antenna 15 and bottom surface 5X is relatively low. Thus, microwaves propagated to radiation antenna 15 are propagated from the rim of radiation antenna 15 to a relatively small degree. Instead, the microwaves are largely propagated from the regions around the intersections respectively of lines L1 and L2 and openings 15Q and 15R (the regions indicated by 15M and 15N in FIG. 11) into heating chamber 10. In the state shown in FIG. 3, the distance in the direction perpendicular to planes 151 and 152 (this direction is hereinafter referred to as perpendicular direction) between bottom surface 5X of body frame 5 and planes 151 and 152 is 15 mm and the distance in the perpendicular direction between bottom surface 5X and planes 154 and 155 is 10 mm.

In the state shown in FIG. 16, radiation antenna 15 is placed at a level higher by 5 mm than that in the state shown in FIG. 3. Namely, the distance in the perpendicular direction between bottom surface 5X of body frame 5 and planes 151 and 152 is 20 mm and the distance in the perpendicular direction between bottom surface 5X and planes 154 and 155 is 15 mm. Then, the impedance in the space between bottom surface 5X and radiation antenna 15 is higher than that in the state shown in FIG. 3. Accordingly, microwaves propagated to radiation antenna 15 are then propagated from respective edges of the planes 151, 152, 154, and 155 of radiation antenna 15 into heating chamber 10.

Microwave oven 1 is thus controlled in such a way that, if microwaves are to be supplied locally into heating chamber 10 radiation antenna 15 is controlled to be positioned as shown in FIG. 3 and, if microwaves are to be supplied to the whole of heating chamber 10, radiation antenna 15 is controlled to be positioned as shown in FIG. 16.

Figure 17:
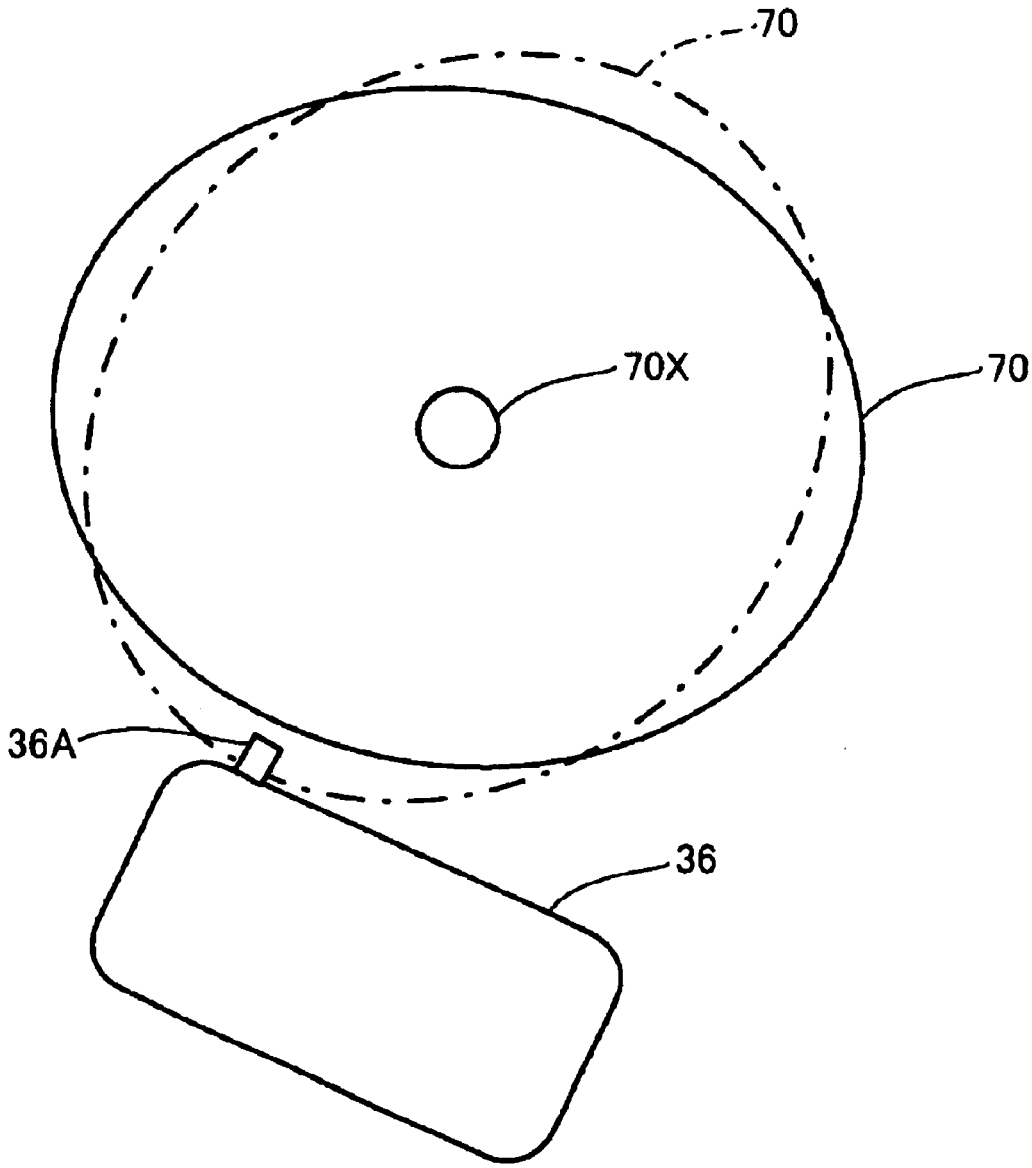
FIG. 17 is a plan view of a rotation member and an antenna sensing switch in the antenna drive box in FIG. 14.

The level of radiation antenna 15 depends on the level at which shaft 15A is supported by rotation member 70. The level at which shaft 15A is supported by rotation member 70 depends on the position where rotation member 70 stops rotating. The position where rotation member 70 stops rotating is controlled based on a sensing output of antenna sensing switch 36. FIG. 17 is a plan view of rotation member 70 and antenna sensing switch 36 within antenna drive box 16.

Rotation member 70 is elliptical as seen from the above and rotates about a center 70X. When a button 36A is pressed, antenna sensing switch 36 outputs the result of detection (sensing output).

Referring to FIG. 17, the solid line and the broken line represent respective positions where rotation member 70 stops rotating. As seen from this, depending on the position where rotation member 70 stops rotating, button 36A is pressed or not pressed. For microwave oven 1, therefore, the particular position where rotation member 70 rotates can be ascertained from the fact that button 36A is pressed. Further, the position where rotation member 70 stops rotating can be controlled by control of the time from the point when button 36A is pressed to the point when rotation member 70 is stopped from rotating. These components are structured in such a manner that, rotation member 70 is at the position where rotation member 70 does not press button 36A of antenna sensing switch 36 when rotation member 70 rotates to move radiation antenna 15 to a predetermined position which is supposed to be frequently taken in use, namely, in this embodiment, when radiation antenna 15 is at the lowest level. This structure allows no force to be exerted on button 36A of antenna sensing switch 36 in a standby state and only allows force to be exerted thereon when necessary, therefore, the lifetime of antenna sensing switch 36 can be extended.

Figure 18:
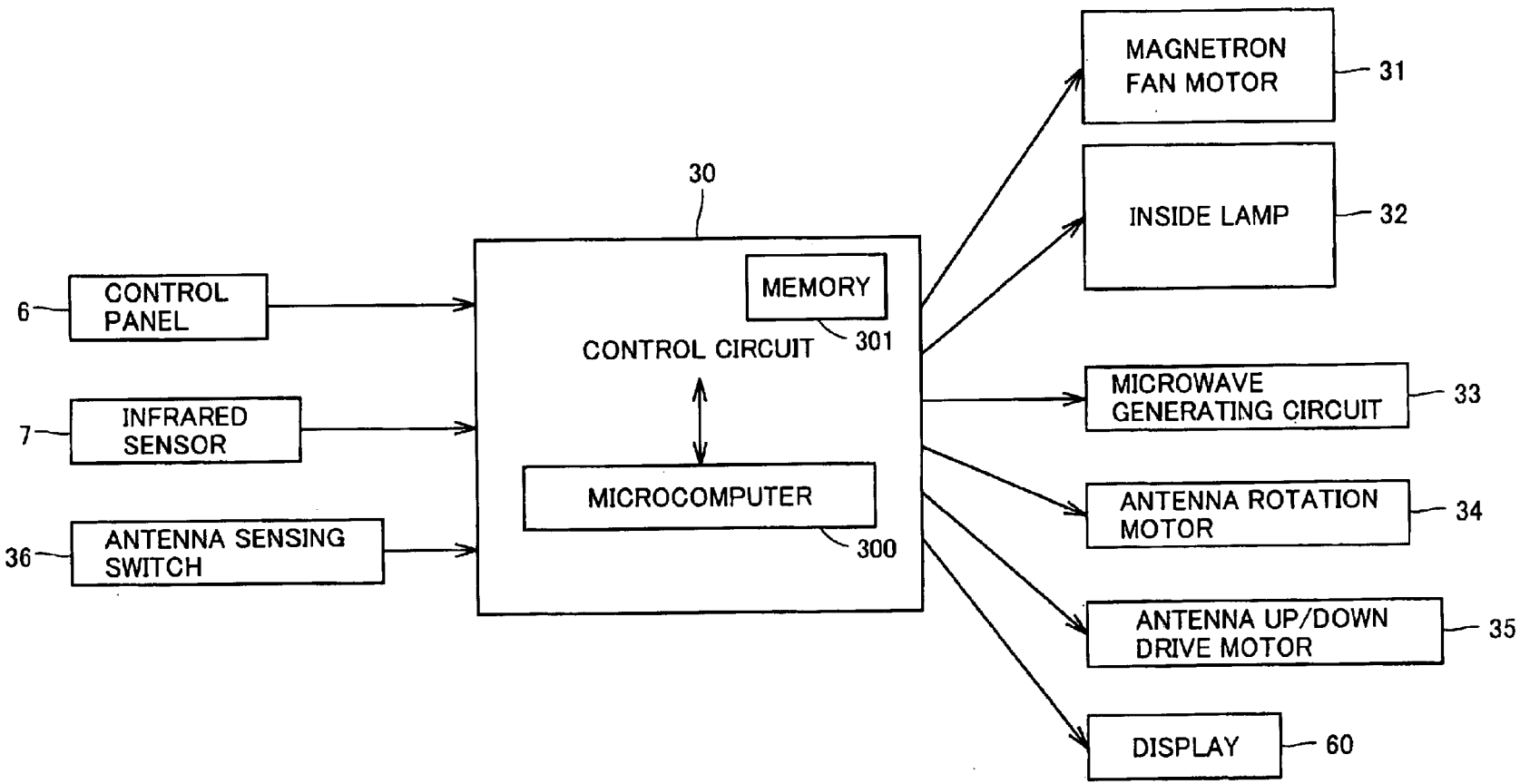
FIG. 18 is a control block diagram of the microwave oven in FIG. 1.

FIG. 18 is a control block diagram of microwave oven 1. Microwave oven 1 has a control circuit 30 which generally controls operations of microwave oven 1. Control circuit 30 includes a microcomputer 300 and a memory 301 for appropriately recording information.

Control circuit 30 receives various information from control panel 6, infrared sensor 7 and antenna sensing switch 36. Based on the received various information, control circuit 30 controls respective operations of a magnetron fan motor 31, an inside lamp 32, a microwave generating circuit 33, antenna rotation motor 34, antenna up/down drive motor 35 and a display 60. Magnetron fan motor 31 is a fan which serves to cool magnetron 12. Inside lamp 32 serves to illuminate the inside of heating chamber 10. Microwave generating circuit 33 serves to cause magnetron 12 to generate microwaves. Display 60 is provided to control panel 6 for appropriately displaying information.

Figure 19:
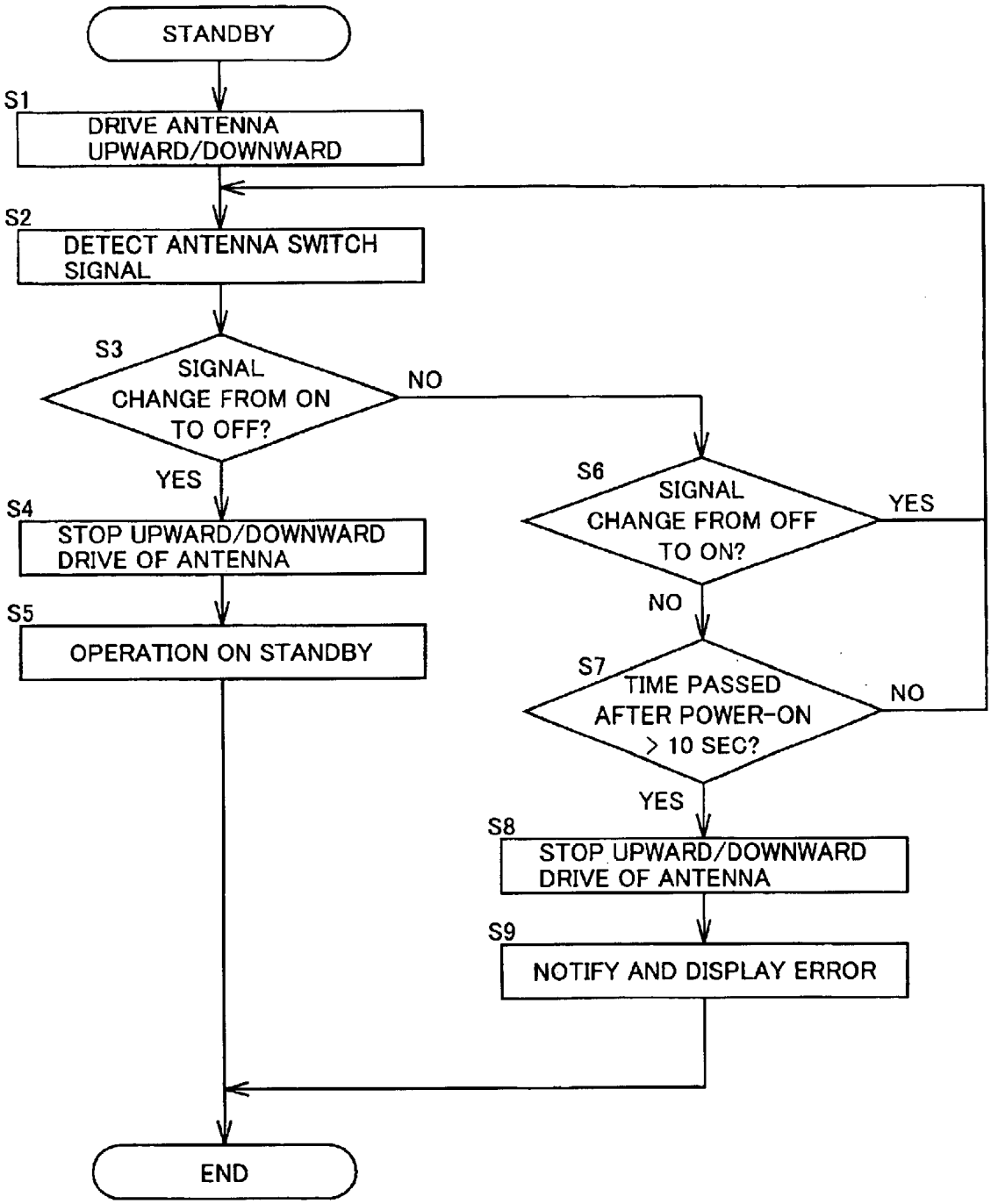
FIG. 19 is a flowchart for a standby process followed by a control circuit in the period from the time when the microwave oven in FIG. 1 is powered to a cooking operation.

FIG. 19 is a flowchart for a standby process followed by control circuit 30 from the time when microwave oven 1 is powered to the time when cooking is done.

When microwave oven 1 is powered, control circuit 30 continuously drives antenna up/down drive motor 35 in step S1 (hereinafter without "step") to move radiation antenna 15 upward/downward.

In S2, control circuit 30 checks a sensing output from antenna sensing switch 36.

In S3, control circuit 30 determines whether or not the sensing output from antenna sensing switch 36 changes from ON to OFF. Here, antenna sensing switch 36 provides, to control circuit 30, a sensing output of ON in the period in which button 36A is being pressed or provides a sensing output of OFF when button 36A is released from being pressed. If it is determined in S3 that the sensing output changes from ON to OFF, the process proceeds to S4 and, if it is determined that such a change of the sensing output is not detected, the process proceeds to S6.

In S4, antenna up/down drive motor 35 is stopped from being driven so as to stop the upward/downward movement of radiation antenna 15. Then, in S5, microwave oven 1 is allowed to enter an operation standby state and this process is completed.

In S6, control circuit 30 determines whether or not a sensing output from antenna sensing switch 36 changes from OFF to ON. If it is determined in S6 that such a change from OFF to ON is detected, the process returns to S2 and, if it is determined that such a change is not detected, the process proceeds to S7.

In S7, control circuit 30 determines whether or not ten seconds have passed from the time when microwave oven 1 is powered. If ten seconds have passed, the process proceeds to S8 and, if ten seconds have not passed, the process returns to S2.

In S8, control circuit 30 stops driving antenna up/down drive motor 35. In S9, it is notified that antenna sensing switch 36 does not normally detect rotations of rotation member 70 even though antenna up/down drive motor 35 is driven and accordingly, the process is completed. Regarding the notification in this case, display unit 60 may show a particular indication, or microwave oven 1 may have an audio circuit to output a particular sound.

Through the standby process described above in connection with FIG. 19, microwave oven 1 checks, before cooking is done, whether or not the level of the radiation antenna is normally changed appropriately, i.e., whether or not the way to supply microwaves into heating chamber 10 is normally changed appropriately and, if any abnormal condition is found, this abnormal condition is notified.

Figure 20:
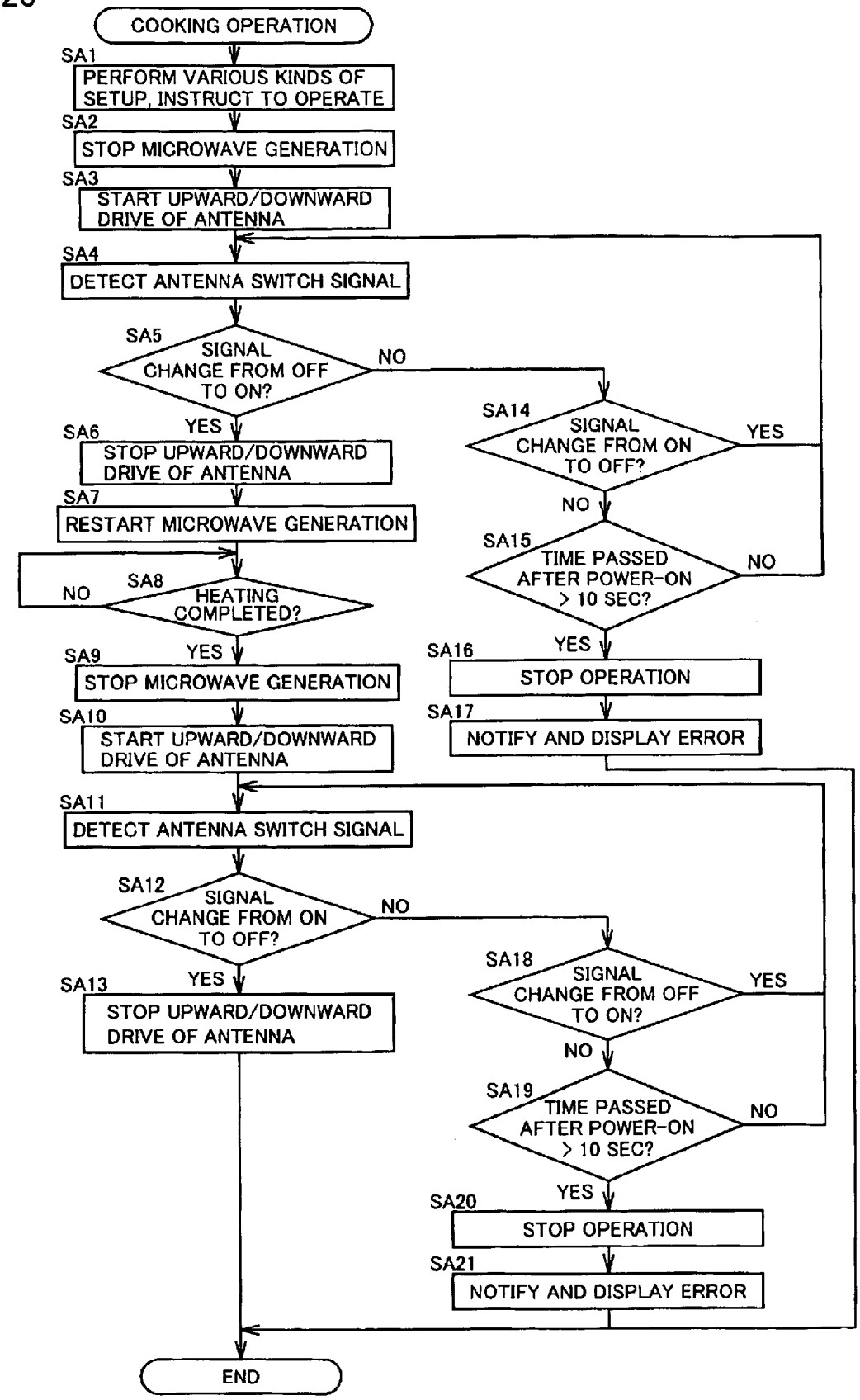
FIG. 20 is a flowchart for a cooking process followed by the control circuit when a stuff to be heated within the heating chamber is heated in the microwave oven in FIG. 1.

FIG. 20 is a flowchart for a cooking process followed by control circuit 30 when heating of a stuff to be heated in heating chamber 10 is done.

When microwave oven 1 is on standby and control panel 6 is operated for starting the heating, control circuit 30 performs various kinds of setup according to the contents of the operation of control panel 6 and, following an instruction to operate (a start button on control panel 6 is manipulated), control circuit 30 causes magnetron 12 to start generating microwaves and thereby starts a heating operation in SA1.

In SA2, control circuit 30 stops magnetron 12 from generating microwaves in order to move radiation antenna 15 upward/downward.

In SA3, control circuit 30 drives antenna up/down drive motor 35 to move radiation antenna 15 upward/downward.

In SA4, control circuit 30 checks a sensing output from antenna sensing switch 36.

In SA5, control circuit 30 determines whether or not the sensing output from antenna sensing switch 36 changes from OFF to ON. If it is determined in SA5 that the output changes from OFF to ON, the process proceeds to SA6. If it is determined that the change from OFF to ON is not detected, the process proceeds to SA14.

In SA6, control circuit 30 stops driving antenna up/down drive motor 35 and thereby stops the upward/downward movement of radiation antenna 15.

In SA7, control circuit 30 allows magnetron 12 to restart generating microwaves.

In SA8, control circuit 30 determines whether or not it is appropriate to stop heating by microwaves. Specifically, this determination is made by determining whether or not heating by microwaves is done for the time which is set in advance through control panel 6 for example, or by determining whether or not the temperature of the stuff to be heated that is detected by infrared sensor 7 reaches a predetermined temperature. Then, when it is determined that stopping of the heating is appropriate, the process proceeds to SA9.

In SA9, control circuit 30 causes magnetron 12 to stop generating microwaves.

In SA10, control circuit 30 drives antenna up/down drive motor 35 to move radiation antenna 15 upward/downward.

In SA11, control circuit 30 checks a sensing output from antenna sensing switch 36.

In SA12, control circuit 30 determines whether the sensing output from antenna sensing switch 36 changes from ON to OFF. If such a change of the sensing output from ON to OFF is detected in SA12, the process proceeds to SA13. If it is determined that such a change does not occur, the process proceeds to SA18.

In SA13, control circuit 30 stops driving antenna up/down drive motor 35 to stop radiation antenna 15 and accordingly completes the cooking operation.

On the other hand, in SA18, control circuit 30 determines whether or not a sensing output from antenna sensing switch 36 changes from OFF to ON. If it is determined in SA18 that such a change of the sensing output is detected, the process returns to SA11 and, if it is determined that such a change of the sensing output is not detected, the process proceeds to SA19.

In SA19, control circuit 30 determines whether or not ten seconds have passed from the time when driving of antenna up/down drive motor 35 is started in SA3. If ten seconds have passed, the process proceeds to SA20. If not, the process returns to SA11.

In SA20, control circuit 30 operates for stopping antenna up/down drive motor 35 and for stopping the heating operation.

In SA21, control circuit 30 provides a notification that antenna sensing switch 36 does not normally detect rotations of rotation member 70 even though it drives antenna up/down motor 35, and then completes the process.

On the other hand, in SA14, control circuit 30 determines whether or not the sensing output from antenna sensing switch 36 changes from OFF to ON. If such a change of the sensing output is detected in SA14, the process returns to SA4 and, if such a change is not detected, the process proceeds to SA15.

In SA15, control circuit 30 determines whether or not ten seconds have passed from the time when it starts driving antenna up/down drive motor 35 in SA3. If ten seconds have passed, the process proceeds to SA16 and, if ten seconds have not passed, the process returns to SA4.

In SA16, control circuit 30 operates for stopping antenna up/down drive motor 35 and for stopping the heating operation.

In SA17, control circuit 30 provides a notification that antenna sensing switch 36 does not normally detect rotations of rotation member 70 even though it drives antenna up/down drive motor 35, and then completes the process.

In the cooking process of the above-described embodiment, if an expected sensing signal is not obtained from antenna sensing switch 36 even though antenna up/down drive motor 35 is driven for a predetermined time (ten seconds), magnetron 12 is stopped from being driven and this abnormal state is notified.

Further, in the cooking process as described above, when antenna up/down drive motor 35 is driven, namely, radiation antenna 15 is moved upward/downward, magnetron 12 is stopped from operating. Accordingly, when the way to supply microwaves into heating chamber 10 is changed by moving radiation antenna 15 upward/downward, microwaves are stopped from being supplied into heating chamber 10.

Moreover, in the cooking process as described above, the level of radiation antenna 15 in the up/down direction is, when heating is done by microwaves, determined according to the items set on control panel 6 in SA1 and accordingly controlled. Here, suppose that an instruction is entered from operation panel 6 to execute a cooking operation for a menu for which microwaves should be supplied into the whole of heating chamber 10. Then, in the step of stopping upward/downward movement of radiation antenna 15 in SAG, driving of antenna up/down motor 35 is stopped at a predetermined timing for allowing radiation antenna 15 to be in the state shown in FIG. 16, after a sensing output from antenna sensing switch 36 is obtained in SA5. Then, suppose that an instruction is entered from operation panel 6 to execute a cooking operation for a menu for which microwaves should be supplied locally into heating chamber 10. Accordingly, in the step of stopping upward/downward movement of radiation antenna 15 in SA6, driving of antenna up/down motor 35 is stopped at a predetermined timing for allowing radiation antenna 15 to be in the state shown in FIG. 3, after a sensing output from antenna sensing switch 36 is obtained in SA5.

Even after driving of magnetron 12 is stopped in SA9 for completing the cooking operation, radiation antenna 15 is moved upward/downward in these steps SA10–SA13, SA18 and SA19. In this case, it is preferable that radiation antenna 15 is moved to one of the positions shown respectively in FIG. 3 and FIG. 16, at which radiation antenna 15 have more frequently been moved by the control in the past cooking operations in microwave oven 1. The standby position of radiation antenna 15 before the subsequent cooking operation is thus set at a position at which the radiation antenna 15 has more frequently been placed, so that control of movement of radiation antenna 15 in microwave oven 1 can be facilitated. In such a case, if it is unnecessary in a cooking operation to check the level of radiation antenna 15 to move the antenna upward/downward each time heating is started, antenna up/down drive motor 35 may be controlled such that motor 35 is not to driven.

For microwave oven 1 in the above-described embodiment, the level in the up/down direction of radiation antenna 15 is controlled as shown in FIG. 3 or FIG. 16 to change the way to supply microwaves into heating chamber 10. Effects derived from such a control of the level of the radiation antenna are specifically described below.

Figure 21:
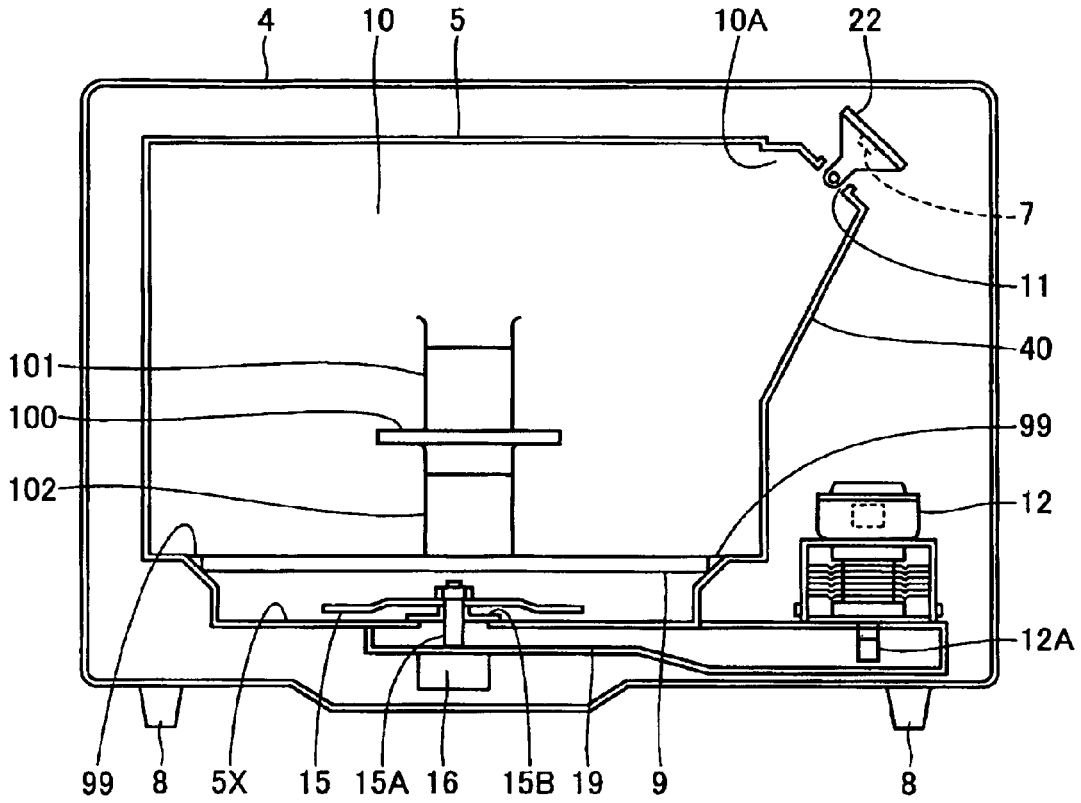
FIGS. 21 and 22 are illustrations for describing effects derived from position control of the radiation antenna in the microwave oven in FIG. 1.
Figure 22:
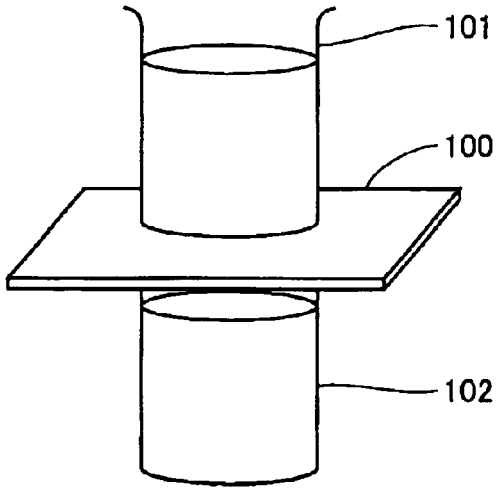

Table 2 shows the temperature by which water (100 cc) in each of two stacked beakers 101 and 102 in heating chamber 10 as shown in FIG. 21 increases after being heated for 40 seconds. Beakers 101 and 102 are the same in shape, and a resin plate 100 transmitting microwaves is provided between beakers 101 and 102. FIG. 22 is a perspective view of beakers 101 and 102 and plate 101 that are placed within heating chamber 10. The water is heated with an output of 1000 W of magnetron 12. In Table 2, "antenna position: high" means that radiation antenna 15 is in the state shown in FIG. 16 while "antenna position: low" means that radiation antenna 15 is in the state shown in FIG. 3.

TABLE 2

| | water load (upper) | water load (lower) | temp. difference (lower-upper) |
|---|---|---|---|
| antenna position: high | 19.8 deg. | 22.2 deg. | 2.4 deg. |
| antenna position: low | 19.1 deg. | 28.9 deg. | 9.8 deg. |

Referring to Table 2, when microwaves are supplied while the antenna is positioned "high," the temperature of the water in upper beaker 101 increases by 19.8 degrees while the temperature of the water in lower beaker 102 increases by 22.2 degrees. Accordingly, the temperature by which the water in lower beaker 102 increases is greater by 2.4 degrees than that of the water in upper beaker 101.

When microwaves are supplied while the antenna is positioned "low," the temperature of the water in upper beaker 101 increases by 19.1 degrees while the temperature of the water in lower beaker 102 increases by 28.9 degrees. Accordingly, the temperature by which the water in lower beaker 102 increases is greater by 9.8 degrees than that of the water in upper beaker 101.

Thus, when the antenna is at the position "low," food put within heating chamber 10 can more intensively be heated from below, as compared with the case in which the antenna is at the position "high." When the antenna is at the position "high," food can more entirely and uniformly be heated particularly in the direction perpendicular to the bottom plate within heating chamber 10, as compared with the case in which the antenna is at the position "low."

According to the above-described embodiment, although radiation antenna 15 in microwave oven 1 is placed below a stuff to be heated so that the distance between bottom surface 5X of body frame 5 and radiation antenna 15 can be changed, the present invention is not limited this arrangement. For example, radiation antenna 15 may be placed to face a lateral side of heating chamber 10 so that the distance between the lateral side and the radiation antenna can be changed. Even if radiation antenna 15 is placed in this way, microwaves can be supplied into heating chamber 10 of microwave oven 1 locally and entirely.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven comprising:

a heating chamber holding food therein;

a magnetron generating microwaves;

a radiation antenna provided in said heating chamber for radiating the microwaves generated by said magnetron into said heating chamber; and an antenna moving unit moving said radiation antenna, wherein said radiation antenna includes a first plane facing an inner wall of said heating chamber and a second plane facing said inner wall and located closer to said inner wall relative to said first plane, said first plane has an opening formed therein, and said antenna moving unit is capable of moving said radiation antenna between a first position and a second position by changing the distance between said radiation antenna and said inner wall, said radiation antenna at said first position radiating the microwaves generated by said magnetron from an edge of said opening and said radiation antenna at said second position radiating the microwaves generated by said magnetron from respective edges of said first plane and said second plane.

2. The microwave oven according to claim 1, wherein said antenna moving unit rotates said radiation antenna.

3. The microwave oven according to claim 2, wherein said antenna moving unit moves said radiation antenna between said first position and said second position while rotating said radiation antenna.

4. The microwave oven according to claim 1, wherein said antenna moving unit moves said radiation antenna in a predetermined manner before said magnetron starts generating microwave.

5. The microwave oven according to claim 1, wherein said antenna moving unit stops said radiation antenna at a predetermined position when said magnetron completes its operation.

6. The microwave oven according to claim 5, further comprising a switch turned on/off according to where said radiation antenna is positioned, said switch being turned off when said radiation antenna is at said predetermined position.

7. The microwave oven according to claim 1, wherein said antenna moving unit stops said radiation antenna at said first position or said second position only.

8. The microwave oven according to claim 1, further comprising a number storing unit storing the number of times said radiation antenna has been stopped at said first position and the number of times said radiation antenna has been stopped at said second position, wherein when said microwave oven is powered, said antenna moving unit stops said radiation antenna at one of said first position and said second position, at which said radiation antenna has been stopped a greater number of times which is stored in said storing unit.

9. The microwave oven according to claim 1, further comprising a number storing unit storing the number of times said radiation antenna has been stopped at said first position and the number of times said radiation antenna has been stopped at said second position, wherein when said magnetron completes its operation, said antenna moving unit stops said radiation antenna at one of said first position and said second position, at which said radiation antenna has been stopped a greater number of times which is stored in said storing unit.

10. The microwave oven according to claim 1, further comprising an antenna position sensing unit detecting that said radiation antenna is at said first position and/or said second position, wherein said antenna moving unit stops said radiation antenna from moving when no sensing output is obtained from said antenna position sensing unit even though said radiation antenna is moved for a predetermined time.

11. The microwave oven according to claim 10, further comprising a magnetron control unit controlling operation of said magnetron, wherein said magnetron control unit stops said magnetron from generating microwaves when no sensing output is obtained from said antenna position sensing unit even though said antenna moving unit moves said radiation antenna for a predetermined time.

12. The microwave oven according to claim 10, further comprising a notifying unit providing a notification, when said antenna moving unit stops movement of said radiation antenna, that said antenna moving unit stops said radiation antenna from moving for the reason that no sensing output is obtained from said antenna position sensing unit.

13. The microwave oven according to claim 1, further comprising a magnetron control unit controlling operation of said magnetron, wherein said magnetron control unit allows said magnetron to generate microwaves on the condition that said radiation antenna is stopped at said first position or said second position.

* * * * *